US009038503B2

(12) United States Patent
Bartholomew et al.

(10) Patent No.: US 9,038,503 B2
(45) Date of Patent: May 26, 2015

(54) CAP HANDLING TOOLS AND METHODS OF USE

(75) Inventors: Cheryl A. Bartholomew, Lake Elmo, MN (US); Jason W. Bjork, Newport, MN (US); Neil Percy, St. Paul, MN (US); Gregory W. Sitton, Minneapolis, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/234,743

(22) PCT Filed: Aug. 2, 2012

(86) PCT No.: PCT/US2012/049242

§ 371 (c)(1),
(2), (4) Date: Jan. 24, 2014

(87) PCT Pub. No.: WO2013/019912

PCT Pub. Date: Feb. 7, 2013

(65) Prior Publication Data

US 2014/0174258 A1 Jun. 26, 2014

Related U.S. Application Data

(60) Provisional application No. 61/514,314, filed on Aug. 2, 2011, provisional application No. 61/514,290, filed on Aug. 2, 2011.

(51) Int. Cl.

| | |
|---|---|
| ***B67B 7/44*** | (2006.01) |
| ***B67B 7/02*** | (2006.01) |
| ***B01L 3/00*** | (2006.01) |
| ***B01L 9/00*** | (2006.01) |

(Continued)

(52) U.S. Cl.

CPC ..... *B67B 7/02* (2013.01); *B01L 3/50853* (2013.01); *B01L 3/50855* (2013.01); *B01L 9/00* (2013.01); *B01L 99/00* (2013.01); *B25B 33/00* (2013.01); *B67B 1/045* (2013.01)

(58) Field of Classification Search

CPC ..... B67B 7/02; B67B 1/045; B01L 9/00
USPC ..... 81/3.09, 3.4, 3.57, 3.47, 3.56, 3.48, 81/3.55, 3.41, 3.36, 3.37; 53/492, 489
See application file for complete search history.

(56) References Cited

U.S. PATENT DOCUMENTS 1,707,398 A * 4/1929 Hyland ..... 81/3.09
3,787,946 A 1/1974 Schimek (Continued)

FOREIGN PATENT DOCUMENTS

WO WO 96/09554 3/1996
WO WO 00/21667 4/2000

*Primary Examiner* — Lee D Wilson
*Assistant Examiner* — Melanie Alexander

(57) ABSTRACT

Tools (100) are provided for use in uncapping one or more of a plurality of linearly-oriented, spaced-apart tubes; each cap having a cap upper surface with a depression. The tools comprise a body (30) having first portion (40) for engagement by a user and a second portion (50) for engaging a plurality of caps. The second portion comprises a plurality of spaced-apart projections (60). Each projection is configured for releasably engaging a cap. The projection may comprise two or more spaced-apart projection elements (62,64). Optionally, the first portion is configured in a non-coplanar relationship with respect to the second portion. Methods of use are also provided.

11 Claims, 16 Drawing Sheets

(51) Int. Cl.

| | |
|---|---|
| ***B01L 99/00*** | (2010.01) |
| ***B25B 33/00*** | (2006.01) |
| ***B67B 1/04*** | (2006.01) |

(56) References Cited

U.S. PATENT DOCUMENTS

| | | | | | |
|---|---|---|---|---|---|
| 4,479,406 | A | * | 10/1984 | Shoemaker, III | 81/3.55 |
| 4,683,782 | A | * | 8/1987 | Warburg | 81/3.57 |
| 4,858,502 | A | | 8/1989 | Warburg | |
| 5,253,551 | A | * | 10/1993 | DeVaughn | 81/3.09 |
| 5,628,962 | A | | 5/1997 | Kanbara et al. | |
| 5,950,504 | A | | 9/1999 | Italia | |
| 5,967,001 | A | * | 10/1999 | Regester | 81/3.55 |
| 6,001,310 | A | | 12/1999 | Shaffer et al. | |
| 6,109,139 | A | * | 8/2000 | Regester et al. | 81/3.47 |
| 6,170,359 | B1 | | 1/2001 | Asa | |
| 6,309,603 | B1 | * | 10/2001 | Locke | 422/72 |
| 2011/0289889 | A1 | * | 12/2011 | Kohanski et al. | 53/485 |

* cited by examiner

CAP HANDLING TOOLS AND METHODS OF USE

CROSS-REFERENCE TO RELATED APPLICATIONS

This application is a national stage filing under 35 U.S.C. 371 of PCT/US2012/049242, filed Aug. 2, 2012, which claims priority to U.S. Provisional Patent Application Nos. 61/514,314 and 61/514,290, both filed on Aug. 2, 2011; each disclosure of which is incorporated herein by reference in its entirety.

BACKGROUND

High-throughput biochemical assays often use of unitary strips of 8 reaction tubes, which ordinarily are loaded into wells in a tube rack for processing. In some apparatus, four such tube racks are processed simultaneously. In use, the operator loads a strip of capped tubes into the tube rack and removes the strip of caps manually by pulling on the tab to lift the caps progressively from the tubes at one end to the other. The tubes are then loaded with the appropriate reagents, usually with a micropipette, and recapped by hand. The procedure of uncapping and recapping is repeated after the process (e.g., DNA amplification) to remove the samples for analysis.

If the tubes are empty, the act of removing the strip of caps in rapid succession obviously does not present any problem of ejecting contents from the tubes. However, when it becomes necessary to uncap tubes that are filled or partially-filled (as in the case of tubes purchased pre-packaged with reagents), it is often the case that some of the contents will be released. Furthermore, recapping the tubes also might result in spillage of some of the contents from the tubes. To minimize spillage, the technician will typically need to carefully remove and/or replace one cap at a time, which is not only tedious and time consuming, but also requires repetitive movements. Moreover, practice has shown that the closely packed tubes in the tube rack are difficult to recap manually. A careless or hurried technician may not always get all of the tubes properly recapped, which may result in test failures due to evaporation or contamination. Removing strips of caps by hand also can result in stretching of the strip, making recapping subject to failure. There exists a need for an improved method to decap and recap tubes.

SUMMARY

The present disclosure generally relates to tools, and methods of use thereof, for removing a plurality of caps from two or more containers. Optionally, the plurality of caps may be configured in a unitary closure device comprising a plurality of caps. Optionally, the tool can be used to restore the caps on the containers. In particular, the present disclosure relates to a tool for removing a plurality of caps from two or more tubes (e.g., microtubes that are used for performing chemical or biochemical reactions such as polymerase chain reaction ("PCR"), for example) and, optionally, restoring the caps onto the tubes. In some embodiments, the tool may be adapted so that the plurality of caps can be temporarily retained on the tool while the tool is placed against a surface (e.g., a laboratory bench top), thereby permitting the operator to use both hands to perform other tasks (e.g., dispense or remove reagents). Advantageously, the tool can be configured so that, while the tool is resting against the surface, the plurality of caps is held on the tool in a position whereby no portion of the cap can contact the surface, thereby preventing contamination of the cap with materials (e.g., chemicals, nucleic acids, microorganisms) that may be present on the surface.

In one aspect, the invention provides a tool for use in handling a plurality of linearly-oriented, spaced-apart caps, each cap having an upper surface with a depression. The tool can comprise a body having a first portion for engagement by a user and a second portion to operationally engage one or more caps of the caps, wherein the first portion is in a non-coplanar relationship with the second portion; wherein the first portion has a first side and a second side; wherein the second portion comprises a plurality of spaced-apart projections linearly aligned along a rotational axis, each projection having a terminus; wherein the plurality of projections are aligned along a rotational axis; wherein each projection of the plurality of projections is adapted to fit closely inside and to operationally engage the depression of one of the plurality of caps; wherein the tool is configured such that, when the second side of the first portion is held against a substantially level surface, the distance between the terminus of each of the two or more projections and the surface is sufficient to hold any portion of a cap engaged on the one or more projections off the surface. In any of the embodiments, the distance between the terminus of each of the two or more projections and the surface can be sufficient to hold any portion of a cap that is engaged by either projection at least 2 mm off the surface. In any embodiment, each of the two or more projections can comprise a least two spaced-apart projection elements. In any embodiment, at least one projection element can comprise a means for engaging the cap. In some embodiments, the tool further can comprise a base, wherein each projection of the plurality of projections comprises a longitudinal axis that defines a length of each projection element, wherein the length of a first projection element is longer than the length of a second projection element. In any embodiment, the mass of the first portion can be greater than the mass of the second portion.

In another aspect, the present disclosure provides a tool for use in handling a plurality of linearly-oriented, spaced-apart caps, each cap having an upper surface with a depression having a wall. The tool can comprise a body having a first portion for engagement by a user and a second portion to operationally engage one or more of the caps; wherein the second portion comprises a plurality of spaced-apart projections linearly aligned along a rotational axis, each projection having a terminus; wherein the two or more projections each are adapted to fit closely inside and to operationally engage the depression of one of the plurality of caps; wherein each projection of the plurality of projections comprises at least two spaced-apart projection elements. In any of the embodiments, at least one projection element can comprise a means for engaging the cap. In any of the embodiments, the tool further can comprise a base, wherein each projection of the plurality of projections comprises a longitudinal axis that defines a length of each projection element, wherein the length of a first projection element is longer than the length of a second projection element. In any of the embodiments, wherein the mass of the first portion can be greater than the mass of the second portion. In any of the embodiment, the tool further can comprise a penetration control element.

In yet another aspect, the present disclosure provides a method of handling a plurality of capped tubes. The method can comprise providing a linear array of two or more spaced-apart capped tubes, wherein each cap has an upper surface with a depression, and the tool of any of the above embodiments. The method further can comprise inserting at least one projection into the depression in the cap of one or more of the tubes and using the tool to remove the cap. In any embodiment of the method, inserting at least one projection into the depression in the cap of one or more of the tubes further can comprise inserting at least two projections into the depression in the cap of two or more of the tubes. In any embodiment, the method further can comprise, while at least one cap is engaged on the tool, placing the first side of the tool against a substantially flat surface; adding a substance to or removing a substance from at least one of the tubes; and using the tool to replace the at least one cap on the tubes.

In yet another aspect, the present disclosure provides a tool for use in handling a cap having an upper surface with a depression. The tool can comprise a body having a first portion for engagement by a user and a second portion to operationally engage the cap, wherein the second portion comprises a projection comprising a terminus and at least two spaced-apart projection elements, wherein the projection is adapted to fit closely inside and to operationally engage the depression of the cap, wherein the tool has an operational axis of rotation. In any embodiment, at least one projection element comprises a means for engaging the cap. In any embodiment, the tool further can comprise a base, wherein the projection comprises a longitudinal axis that defines a length of each projection element, wherein the length of a first projection element is longer than the length of a second projection element. In any of the embodiments, the mass of the first portion can be greater than the mass of the second portion. In any of the embodiments, the first portion can be substantially non-coplanar with the second portion. In any embodiment, the first portion can comprise a first side and a second side; wherein the tool is configured such that, when the second side of the first portion is held against a substantially level surface, the distance between the terminus of the projection and the surface is sufficient to hold any portion of a cap engaged on the projection off the surface. In any embodiment, the tool further can comprise a penetration control element. The disclosure further provides a method of using any of the embodiments of the tool. The method can comprise providing a capped tube, wherein the cap comprises an upper surface with a depression, and any embodiment of the tool; inserting the projection into the depression of the cap; and using the tool to remove the cap from the tube. In any embodiment, the method further can comprise, while the cap is engaged on the tool, placing the first side of the tool against a substantially flat surface; and adding a substance to or removing a substance from the tube. In any embodiment, the method further can comprise using the tool to replace the cap on the tube.

In yet another aspect, the present disclosure provides a tool for use in handling a plurality of linearly-oriented, spaced-apart caps, each cap having an upper surface with a depression. The tool can comprise a body having a first portion configured for engagement by a user and a second portion configured to operationally engage one or more of the caps. The second portion can comprise a plurality of spaced-apart projections linearly aligned along a rotational axis, each projection having a terminus. The each projection of the plurality of projections can be adapted to fit closely inside and to operationally engage the depression of one of the plurality of caps. In any embodiment, at least one projection of the plurality of projections can comprise a means for engaging the depression. In any embodiment, the means for engaging the depression can comprise a cap-engaging face. In any embodiment, the cap-engaging face can comprise at least one angular edge. In any embodiment, means for engaging the depression can comprise an abrasive surface. In any embodiment, the at least one of the plurality of projections further can comprise a cap-releasing face. In any embodiment, the cap-releasing face can be connected to the terminus via a chamfer. In any embodiment, the mass of the first portion can be greater than the mass of the second portion. In any embodiment, the tool can be configured such that, when the first side of the first portion is held against a substantially level surface, the distance between the terminus of a projection and the surface is sufficient to hold any portion of the one or more caps engaged by each of the one or more projections off the surface. In any embodiment, the mass of the first portion can be greater than the mass of the second portion.

In yet another aspect, the present disclosure provides a method of handling a plurality of tubes. The method can comprise providing a linear array of a plurality of tubes, the tubes containing a sample and each tube being closed with a cap, each cap having an upper surface with a depression; and a tool according to any of the above embodiments. The method further can comprise inserting a projection into the depression of a cap in a tube and using the tool to remove the cap from the tube. In any embodiment of the method, using the tool to remove the caps can comprise rotating the tool about the rotational axis. In any embodiment, the method further can comprise while the caps are engaged on the tool, placing the second side of the tool against a substantially flat surface; adding a substance to or removing a substance from the tube; and using the tool to replace the cap on the tube. In any embodiment of the method, using the tool to recap the tubes can comprise rotating the tool substantially about the rotational axis in a direction opposite the first direction.

The invention may provide a number of advantages. For example, the tool can be used both for capping and for decapping one or more tubes. When capping or decapping a plurality of tubes, the tool can be used to cap the plurality of tubes simultaneously or to decap the plurality of tubes simultaneously. In some embodiments, the tool may be used temporarily to hold one or more caps off a surface in order to permit the operator to perform another task without exposing the caps to contaminating substances that may be present on the surface.

Additional details of these and other embodiments are set forth in the accompanying drawings and the description below. Other features, objects and advantages will become apparent from the description and drawings, and from the claims.

DETAILED DESCRIPTION

Figure 1A:
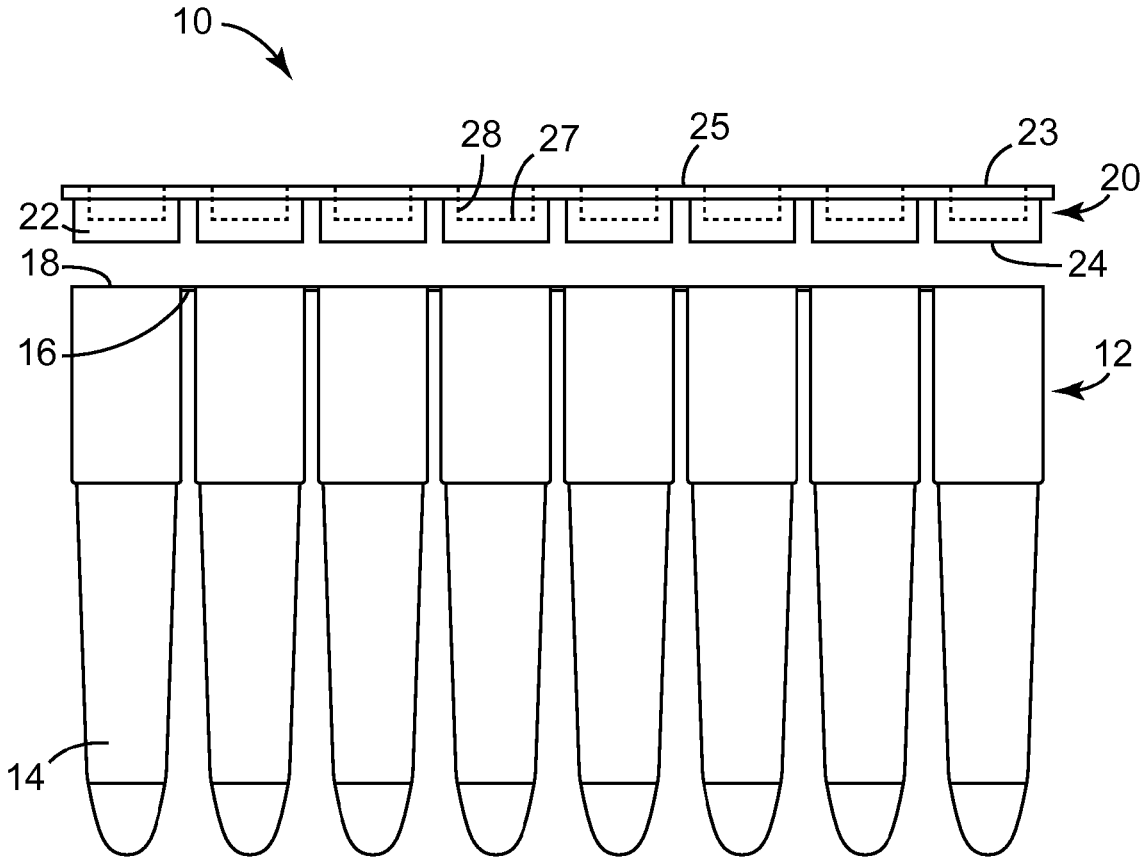
FIG. 1A is an exploded side view of one embodiment of a capped tube assembly.

The present disclosure is directed to a tool that is configured to remove a cap from one tube or a plurality of tubes, each cap having a depression with a wall. In some embodiments, the plurality of tubes can be present in a capped-tube assembly, wherein the tubes are capped (e.g., closed and/or sealed) either using individual caps or using a unitary closure device comprising a plurality of spaced-apart linearly-oriented caps, each cap comprising a depression with a wall. The tool can releasably engage one or more individual caps or one or more caps in a unitary closure device of a capped tube assembly and subsequently, using a single motion, can remove a cap from one or more of the tubes. Advantageously, the at least one removed cap can be held engaged with the tool for a period of time and, subsequently, the tool can be used to restore the at least one removed cap onto the one or more tubes.

FIG. 1 shows an exploded view of one embodiment capped-tube assembly 10. The assembly 10 comprises a unitary multi-tube device 12 comprising a plurality of spaced-apart tubes 14, the multi-tube device 12 capped with a unitary closure device 20. Each tube 14 in the multi-tube device 12 is connected to at least one adjacent tube via a crosspiece 16. Such multi-tube devices 12 and unitary closure devices 20 can be used for chemical and/or biochemical reactions, for example, and both are commercially-available (e.g., from Micronic North America, LLC; McMurray, Pa.). The unitary closure device 20 comprises a plurality of spaced-apart caps 22. Each cap 22 is has a cap top edge 23 and a cap bottom edge 24 and is connected to at least one adjacent cap 22 via a connecting structure 25. Typically, each cap 22 further is dimensioned such that the bottom edge 24 of the cap 22 fits closely within an opening 18 of one of the tubes 14, thereby sealing the tube 14. Each cap 22 further comprises a depression 27 having at least one inner wall 28.

Tools of the present disclosure are configured for use in removing at least one cap from a tube having a cap, the cap having a top surface with a depression with an inner wall. In a preferred embodiment, tools of the present disclosure are used to remove two or more spaced-apart, linearly-oriented caps (e.g., to remove two or more caps 22 of the unitary closure device 20 used to seal tubes in the capped tube assembly 10 of FIG. 1).

FIGS. 2A-D show one embodiment of a first tool 100 for decapping and capping tubes according to the present disclosure. The first tool 100 comprises a body 30 having a first portion 40 and a second portion 50. The body 30 preferably is rigid or semi-rigid and can be constructed from a variety of materials including, for example, metal, plastic, a ceramic material, a composite material, wood, or a combination of any two or more of the foregoing materials.

The first portion 40 of the first tool 100 is configured for engagement by a user. That is, the first portion 40 is intended to be grasped by a person or a machine. In any embodiment, the first portion may comprise an edge 42. Optionally, the edge 42 may comprise a curvate edge 42, for comfort and ease of grasping by a human operator. In any embodiment, the edge 42 further may comprise a bevel 44.

The second portion 50 of the first tool 100 comprises a plurality of spaced-apart projections 60. The projections 60 are linearly aligned along an operational axis of rotation "Y". The first tool 100 further may comprise an optional base 52 or plurality of linearly-aligned and similarly-dimensioned bases 52, as shown in the illustrated embodiment. The base 52 is a reference point in the tool that is located between the operational end (terminus 66) of a projection 60 and the first portion 40 of the first tool 100. Additionally, the base 52 may function to control the depth of penetration of one or more adjacent projections 60 into the depression of a cap (see FIG. 4B).

The spacing of the projections 60 is configured to coincide with the spacing of the depressions in a plurality of caps (for example, see FIGS. 1A-B) that may be removed using the first tool 100. The spacing may be determined by the spacing of the depressions in a unitary closure device as described herein and/or by the spacing of suitable receptacle structures in a rack configured to receive and hold the tubes described herein.

Each projection 60 comprises two or more spaced-apart projection members (i.e., first projection element 62 and second projection element 64), a terminus 66 and a longitudinal axis "Z" with a longitude "L" that extends from the base 52 to the terminus 66. The projections 60 are preferably constructed from a rigid material (e.g., metal, wood, plastic, ceramic, composite materials, or combinations thereof) and may be constructed from the same material as the body 30. In some embodiments, the body 30 and projections 60 may be formed as a unitary part, for example by injection-molding a thermoplastic polymer or by using a stamping process and/or machining process to form the projections in a unitary piece of metal or polymeric material.

Optionally, when making the first tool 100, the projections 60 can be formed on a separate part 54, which can be coupled to the first portion 50 of the body 30 via a fastener 80 such as a bolt, for example.

The largest cross-sectional area of the projection 60 (defined by the spaced-apart projection elements 62 and 64) that extends into the depression during use should fit within the cross-sectional area of the depression (see depression 27 of FIGS. 1A-B); unless the material from which the unitary closure device is constructed is sufficiently flexible to accommodate a projection 60 that has at least one dimension that is slightly larger than the opening. Preferably, the projections 60 are dimensioned to be slightly smaller than the opening, thereby facilitating the insertion and removal of the projections from the openings and also to facilitate contact between the projection 60 and the wall of a depression when using the first tool 100 to remove a cap (not shown) from one or more tubes (not shown).

Projections elements 62 and 64 may be formed in various shapes provided the projection 60 is shaped and dimensioned to be received in the depression of a cap.

At least one projection 60 can comprise a means for engaging the cap of a tube. The means for engaging the cap can include a structure on one or more of the projection elements 62 and 64. For example, both the first projection element 62 and the second projection element comprise an out-turned edge (edges 63 and 65, respectively). In any embodiment, the edges 63 and 65 can comprise angular edges to enhance the engagement of the projection 60 with a cap (not shown). In some embodiments angular edges (edges 63 and 65, for example) can be transversely oriented with respect to the longitudinal axis "Z". The transverse orientation advantageously provides an edge that can engage (e.g., "grip") a cap when the first tool 100 is moved from a first operational position to a second operational position as described below.

In any embodiment, the means for engaging the cap of a tube can comprise an abrasive surface (not shown). For example, the first projection element 62 and/or second projection element 64 further can comprise a rough surface or edge comprising either ordered or random structures that disrupt an otherwise smooth surface. These structures can facilitate the engagement of a cap and, thereby, prevent the projections from slipping out of the cap when the first tool is used.

Figure 2A:
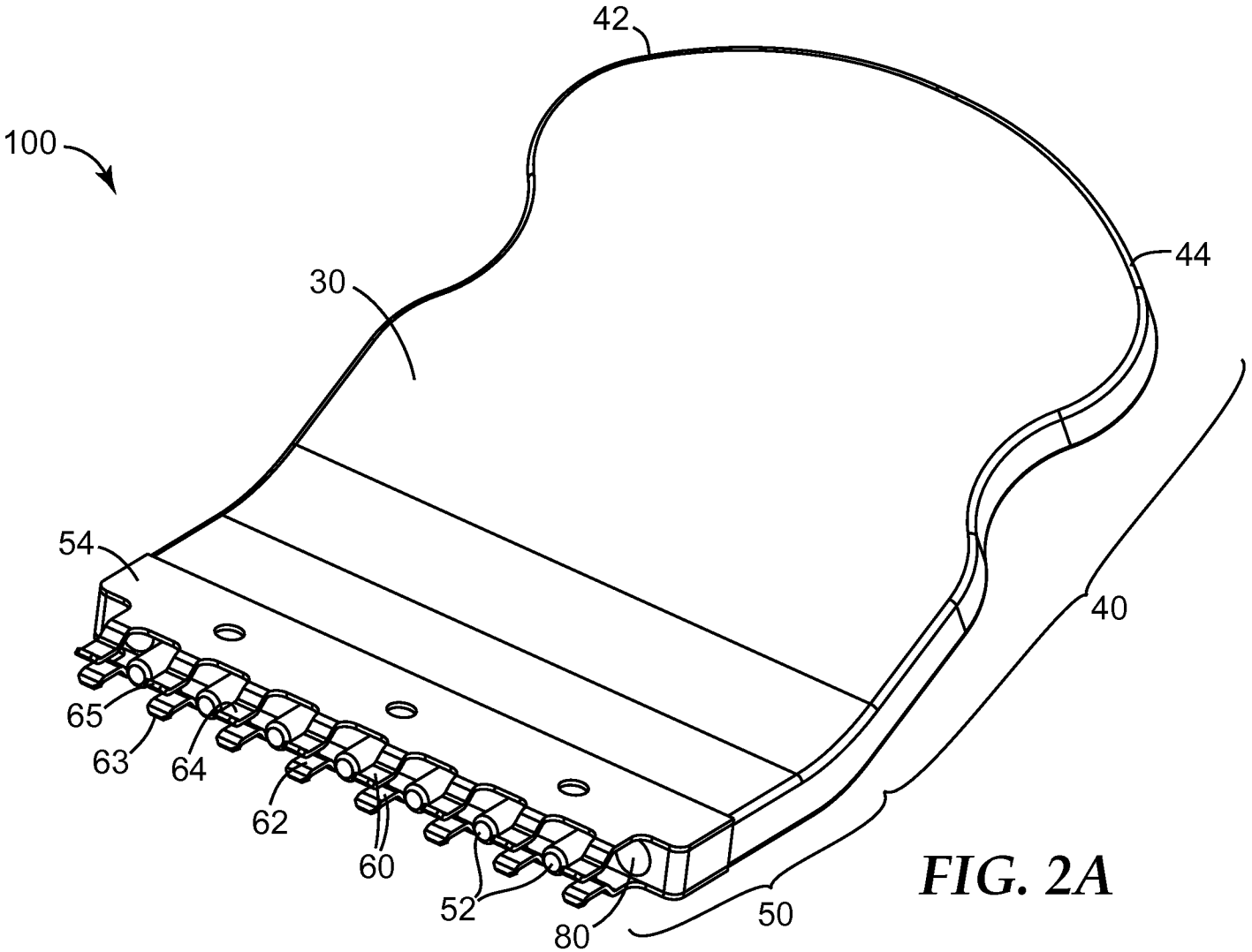
FIG. 2A is a perspective view of one embodiment of a tool for decapping and capping tubes according to the present disclosure.
Figure 2B:
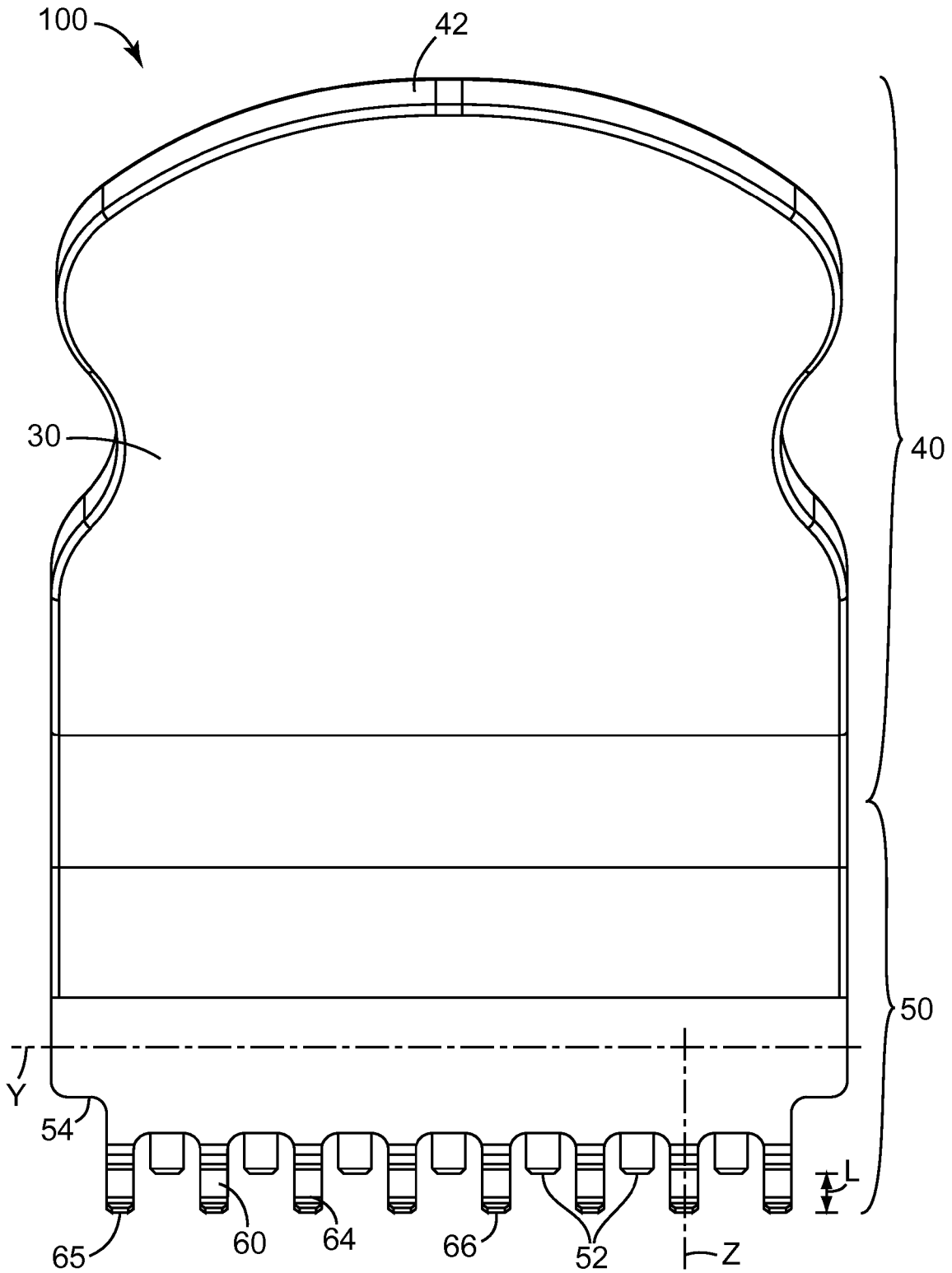
FIG. 2B is a plan view of the tool of FIG. 2A.
Figure 2C:
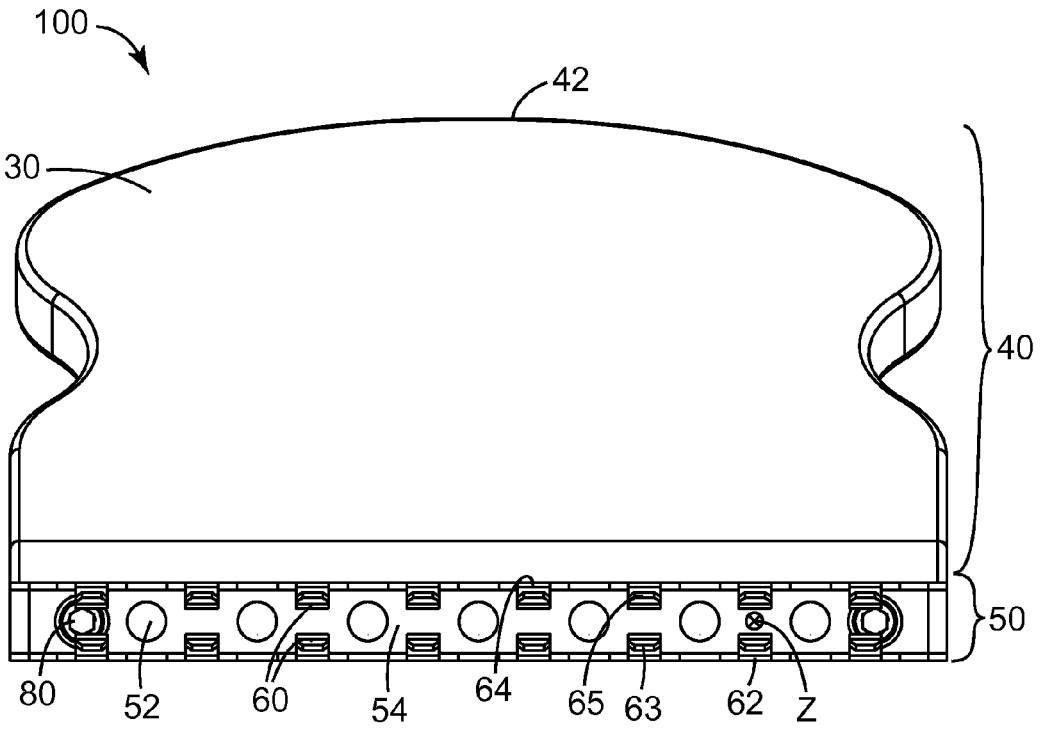
FIG. 2C is a bottom view of the tool of FIG. 2A.
Figure 2D:
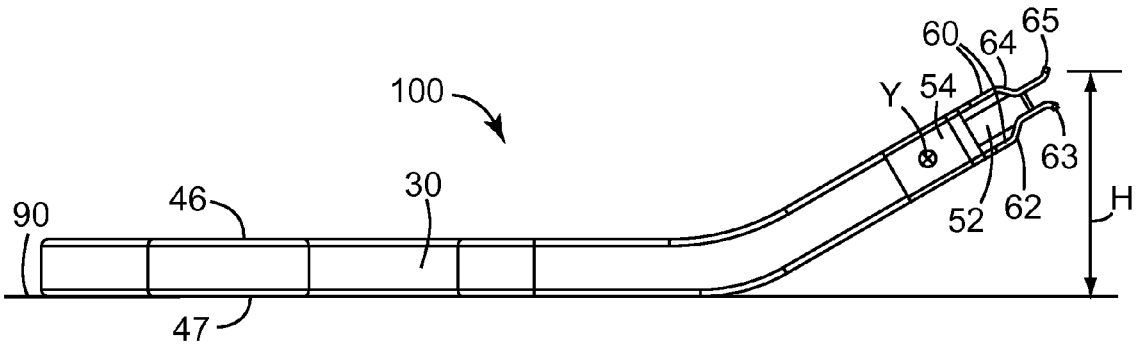
FIG. 2D is a side view of the tool of FIG. 2A disposed on a surface.
Figure 4A:
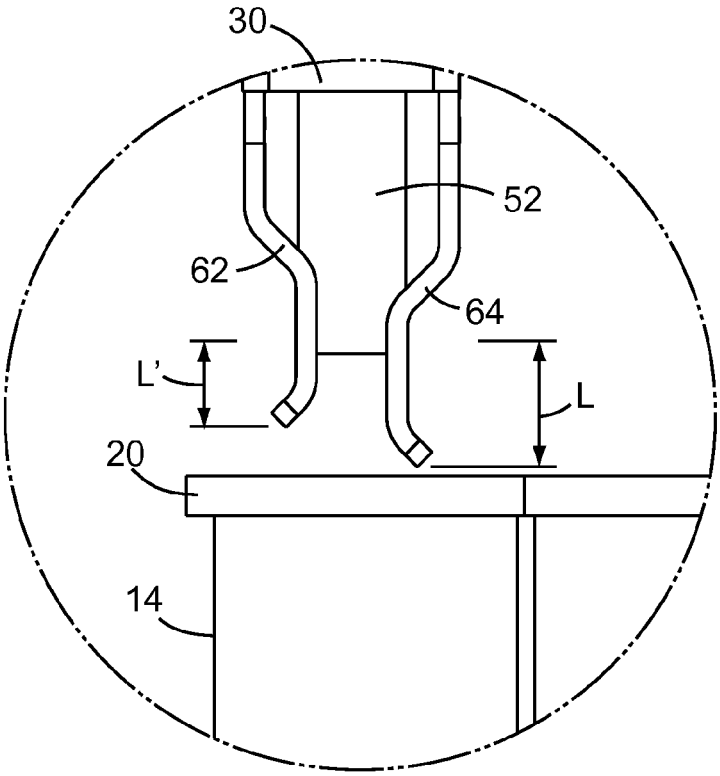
FIG. 4A shows a detailed side view of the second end of tool of FIG. 3A positioned aligned for engagement in a first operable position with the capped tube assembly of FIG. 3A.

It can be seen in FIGS. 2D and 4A that the first projection element has a greater length (L) than the length (L') of the second projection element 64. The difference in length of the first and second projection elements (62 and 64, respectively) substantially prevents the first projection element 62 from operably engaging a cap when the first tool 100 is rotated on axis "Y" away from the first projection element 62, as described below.

Tools of the present disclosure can be used to remove, in as few as two steps, the caps from plurality of tubes. One step in the decapping process includes engaging the caps with the tool. FIG. 4A shows the first tool 100 of FIGS. 2A-D aligned to be engaged in a first operational position with the unitary closure device 20 of a capped tube assembly 10. The plurality of tubes 14 in the capped tube assembly 10 are substantially aligned along the rotational axis "Y" (shown in FIGS. 2C and 2D). The first tool 100 and assembly 10 can be placed in the first operational position (shown in FIGS. 3A and 4B), for example, by having an operator (not shown) grasp the body 30 of the first tool 100, manually align one or more of the projections 60 of the first tool 100 with one or more openings (see opening 18 of FIG. 1A), and manually insert the one or more projections into the one or more openings.

Figure 4B:
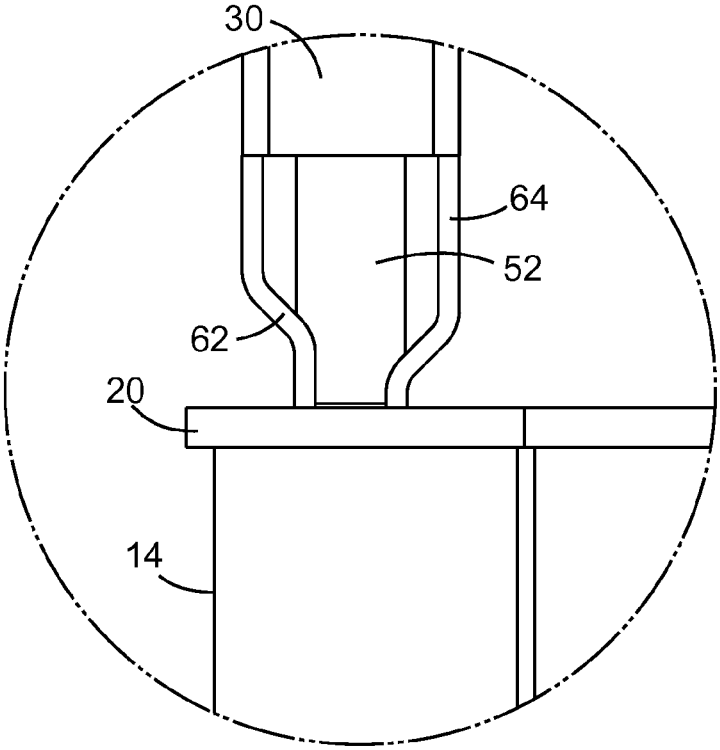
FIG. 4B shows a detailed side view of the tool of FIG. 3A engaged in a first operable position with the capped tube assembly of FIG. 3A.

FIGS. 4A-B show detail of the insertion of a projection 60 of the first tool 100 of FIG. 4A into the depression 27 of a cap 22. The cap 22 is one of a plurality of caps in a unitary closure device 20 that is used to seal a plurality of tubes 14. The body 30 of first tool 100 is held while the projection 60 is aligned with the depression 27 and the first tool is moved to insert the projection 60 into the depression 27 of the cap 22. Preferably, when placing the first tool 100 in the first operational position, the at least one projection 60 should be inserted into the depression 27 until the terminus 66 of the projection 60 contacts the bottom of the depression of the cap.

Figure 3A:
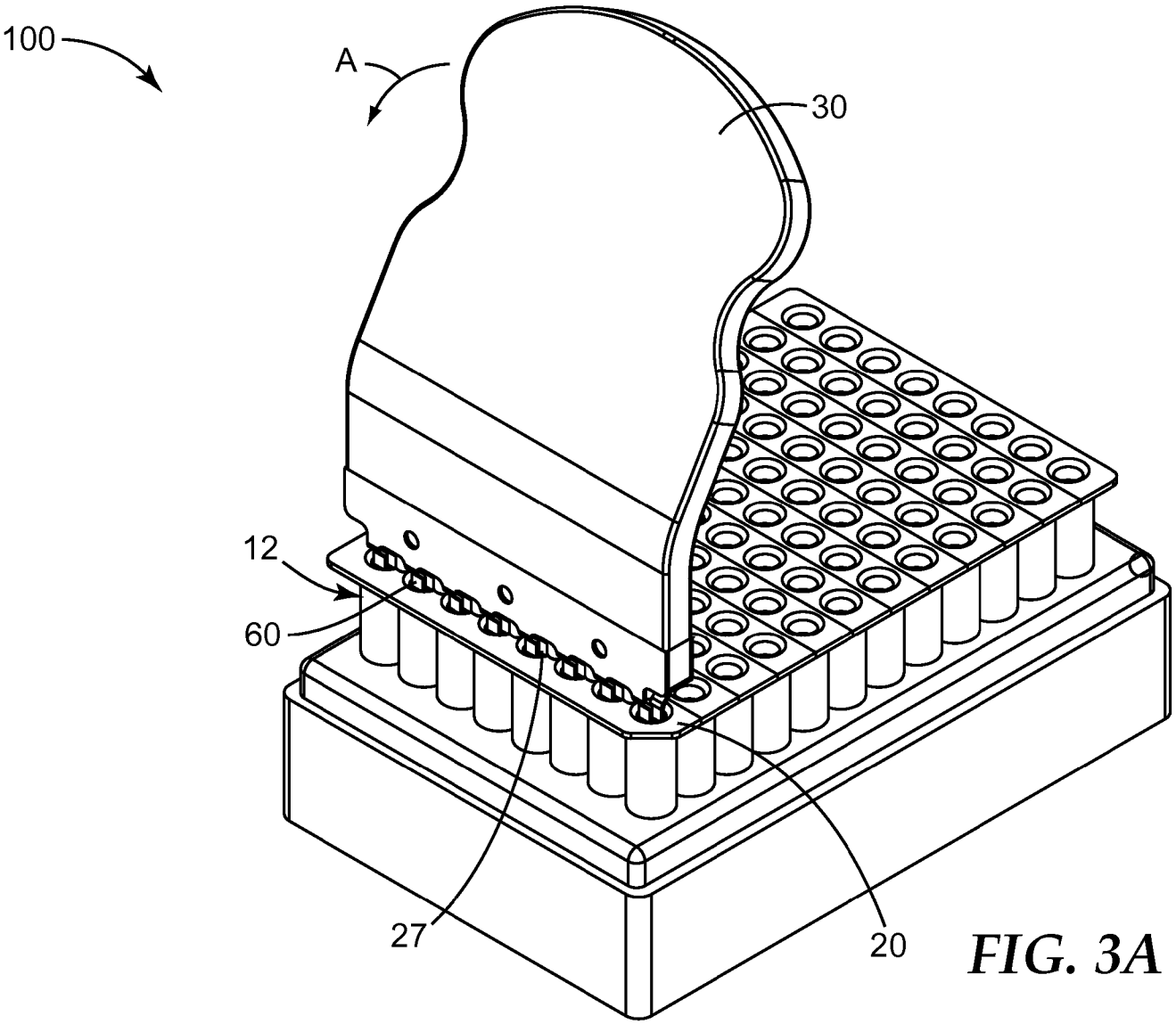
FIG. 3A shows a perspective view of the tool of FIG. 2A engaged in a first operable position with the capped tube assembly of FIG. 1A.
Figure 3B:
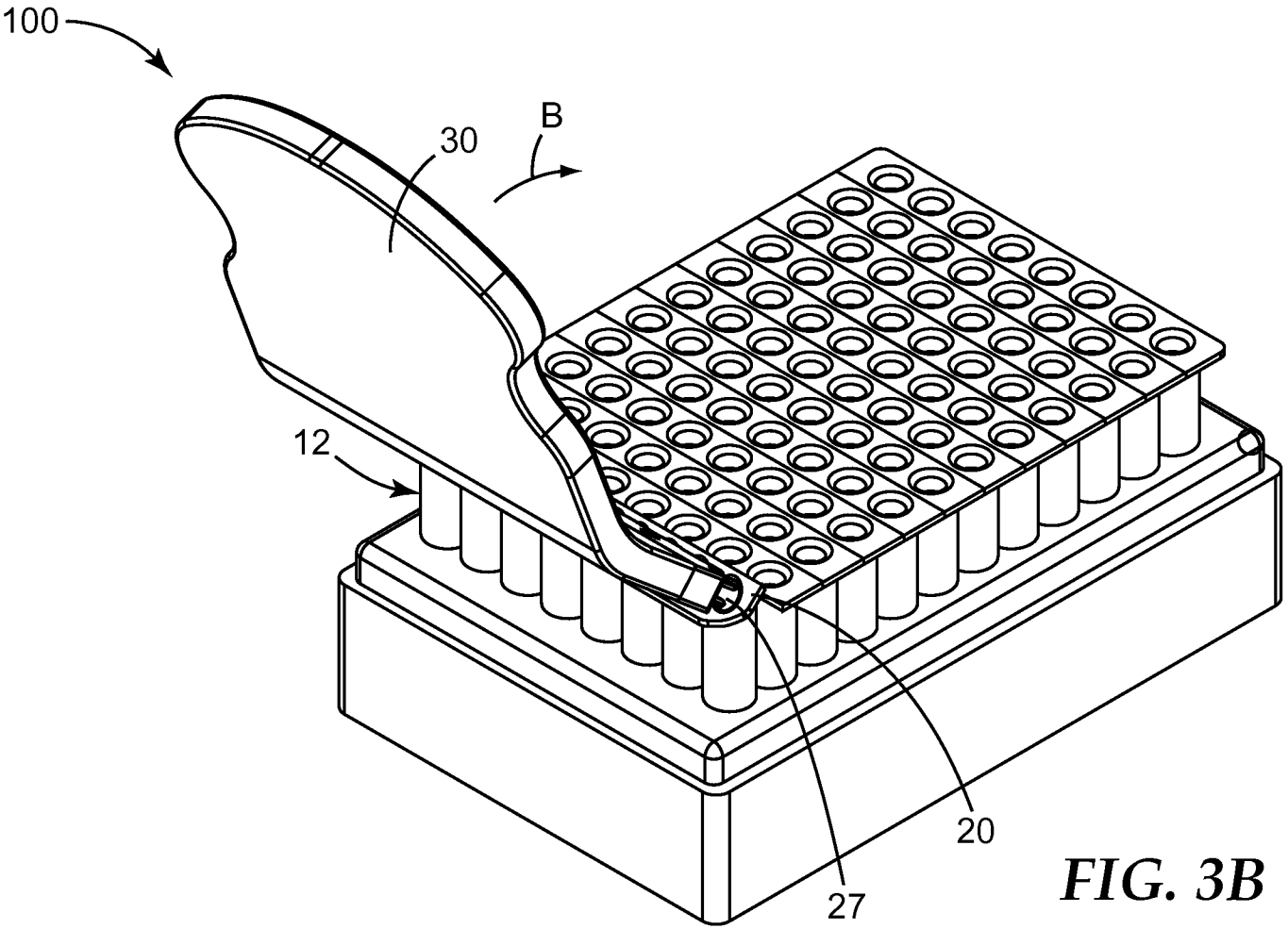
FIG. 3B shows a perspective view of the tool of FIG. 2A engaged in a second operable position with the capped tube assembly.

After the first tool 100 is placed into the first operational position shown in FIG. 3A, a plurality of caps 22 can be removed (e.g., simultaneously removed) from two or more tubes 14 by rotating (e.g., manually rotating) the first tool 100 about the rotational axis "Y", as shown by arrow "A" in FIG. 3A, for example. As the first tool is rotated about the axis "Y", the bottom edge 24 of one or more caps 22 is pried from one or more tubes 14 and, upon sufficient rotation of the first tool 100, the plurality of caps 22 separate from the tubes 14. It is contemplated that, even though a capped tube assembly 10 may comprise more than two tubes 14 (e.g., the assembly may comprise eight or twelve or more tubes 14), the first tool 100 may be used to decap only one tube 14 or to decap two or more tubes. It should be noted that the rotation of the first tool 100 to decap the one or more tubes (i.e., rotation about rotational axis "Y" in the direction of arrow "A" causes the rotation of the first tool 100 in the direction toward the shorter projection element (i.e., projection element 64). Thus the first tool 100 is moved toward the second side (i.e., second side 47 of the first portion 40 of the tool, see FIG. 2D). This rotational motion urges the first projection element 62 against the wall of the depressions in the cap of the tube, thereby lifting the edges of the caps 22 out of the tubes 14.

Figure 5:
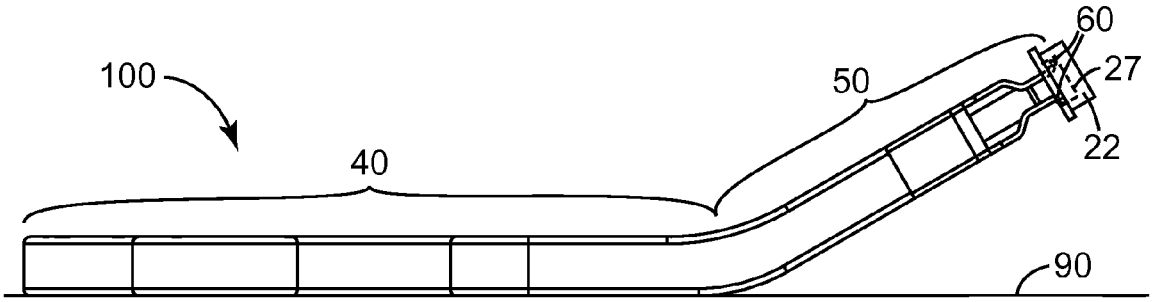
FIG. 5 shows a side view of the tool of FIG. 2A, with a cap engaged thereon, disposed on a surface.

After the unitary closure device 20 is separated from a plurality of tubes 14, if there is a sufficient friction fit between the projection 60 and the depression 27 of the cap 22 or if the first tool 100 is held at a sufficient angle (e.g., the plane of the body 30 is held at an angle where the projections are substantially perpendicular to the force of gravity or the projections are angled upward, away from the force of gravity), the unitary closure device 20 with a plurality of caps 22 can remain releasably engaged with the first tool 100, as shown in FIG. 5.

Figure 6A:
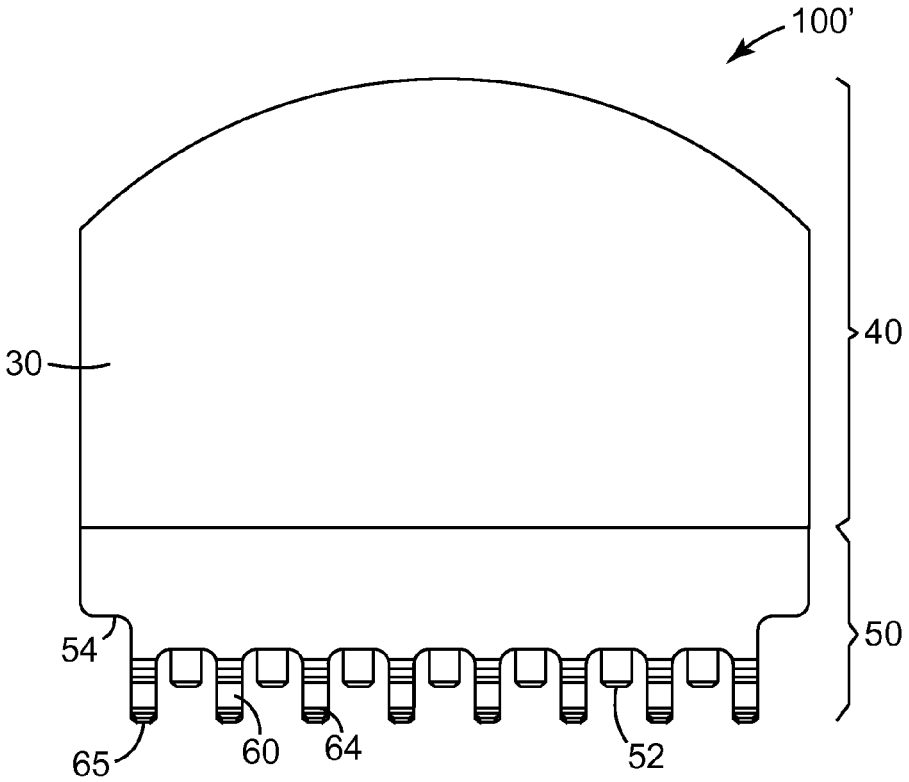
FIG. 6A shows a plan view of an alternative embodiment of a tool for decapping and capping tubes according to the present disclosure.
Figure 6B:
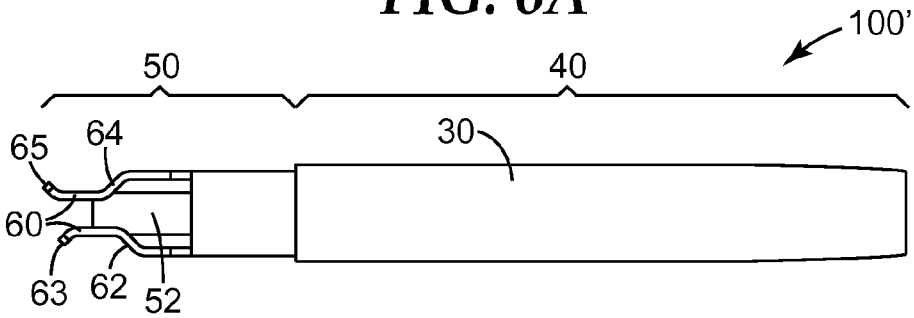
FIG. 6B is a side view of the tool of FIG. 6A.

FIG. 6A-B show one embodiment of a first tool 100' for handling a plurality of linearly-oriented, spaced-apart caps, each cap having an upper surface with a depression. The first tool 100' comprises a first portion 40 and second portion 50. The first portion 40 is configured for engagement by a user, as described above. The second portion 50 comprises a plurality of projections 60 configured to operationally engage, as described above, a plurality of linearly-aligned, spaced-apart caps, each cap having an upper surface with a depression. The projections extend from the base 52 of the body 30. The first portion 40 and second portion 50 are substantially coplanar.

Although the first and second ends of the first tool may be oriented in a substantially co-planar relationship (as shown in FIGS. 6A-B)), optionally, in any of the above embodiments of a first tool for decapping and capping tubes (as illustrated in FIGS. 2A-2D), the first portion of the body can be configured in a non-coplanar relationship with respect to the second portion. FIG. 2D shows a side view of a first tool 100 for decapping and capping tubes, wherein the first tool 100 comprises a first portion 40 of the body 30 in non-coplanar relationship with a second portion 50. The first portion 40 of the first tool 100 is configured for engagement by a user, as described above. The second portion 50 comprises a plurality of projections 60 configured to operationally engage a plurality of linearly-aligned, spaced-apart caps, each cap having an upper surface with a depression. The first portion comprises a first side 46 and a second side 47. The second side 47 can be configured to be placed against a surface 90 such that, when the second side 47 of the first portion 40 is held against the surface 90, the distance "H" between the terminus 66 of the at least one projection 60 and the surface 90 is sufficient to hold any portion of a cap engaged (e.g., fully-engaged) on the projection 60 off the surface 90. Preferably, the distance "H" is sufficient to hold any portion of the engaged cap (not shown) at least 2 mm off the surface. In some embodiments, the distance "H" is sufficient to hold any portion of the projection-engaged cap (not shown) at least 5 mm off the surface. In some embodiments, the distance "H" is sufficient to hold any portion of the projection-engaged cap (not shown) at least 10 mm off the surface. In some embodiments, the distance "H" is sufficient to hold any portion of the projection-engaged cap (not shown) more than 10 mm off the surface. In any embodiment, the first portion may comprise an edge 42. Optionally, the edge 42 may comprise a curvate edge 42, as described above. The second portion 50 of the first tool 100 comprises a base 52 with a plurality of spaced-apart projections 60 extending therefrom, both as described above.

In any of the embodiments, the first portion 40 of the first tool can have a greater mass than the second portion 50 of the first tool. Preferably, the mass of the first portion is greater than the mass of the second portion plus the mass of any caps disposed on one or more of the projections 60. Thus, when a tool (e.g., such as first tool 100 holding a cap as shown in FIG. 5A, is placed on a surface 90 the mass of the first portion 40 can counterbalance the mass of the second portion 50 and the cap 22, thereby keeping the cap 22 from contacting the surface 90.

Figure 8A:
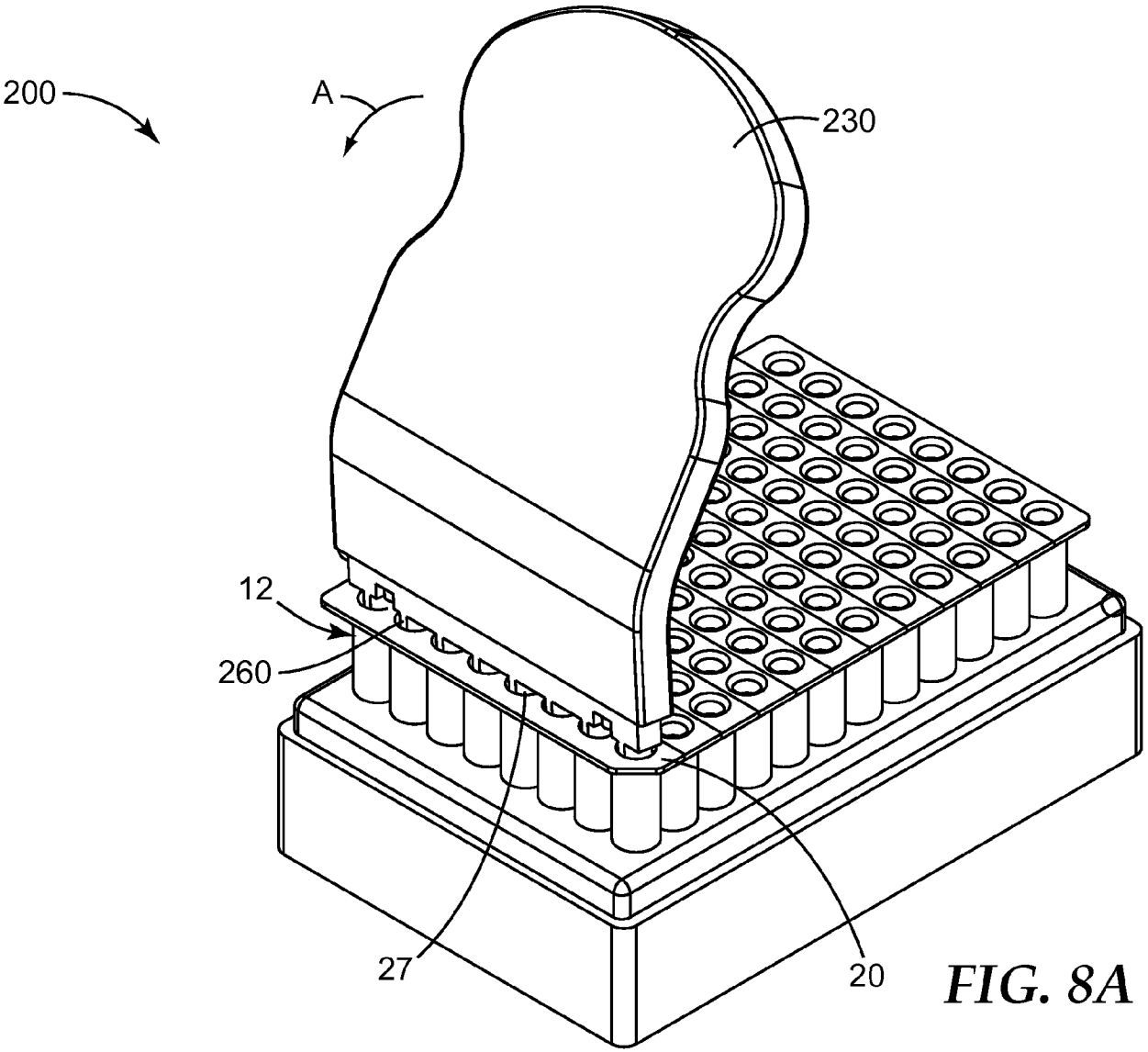
FIG. 8A shows a perspective view of the tool of FIG. 7A engaged in a first operable position with the capped tube assembly of FIG. 1A.
Figure 8B:
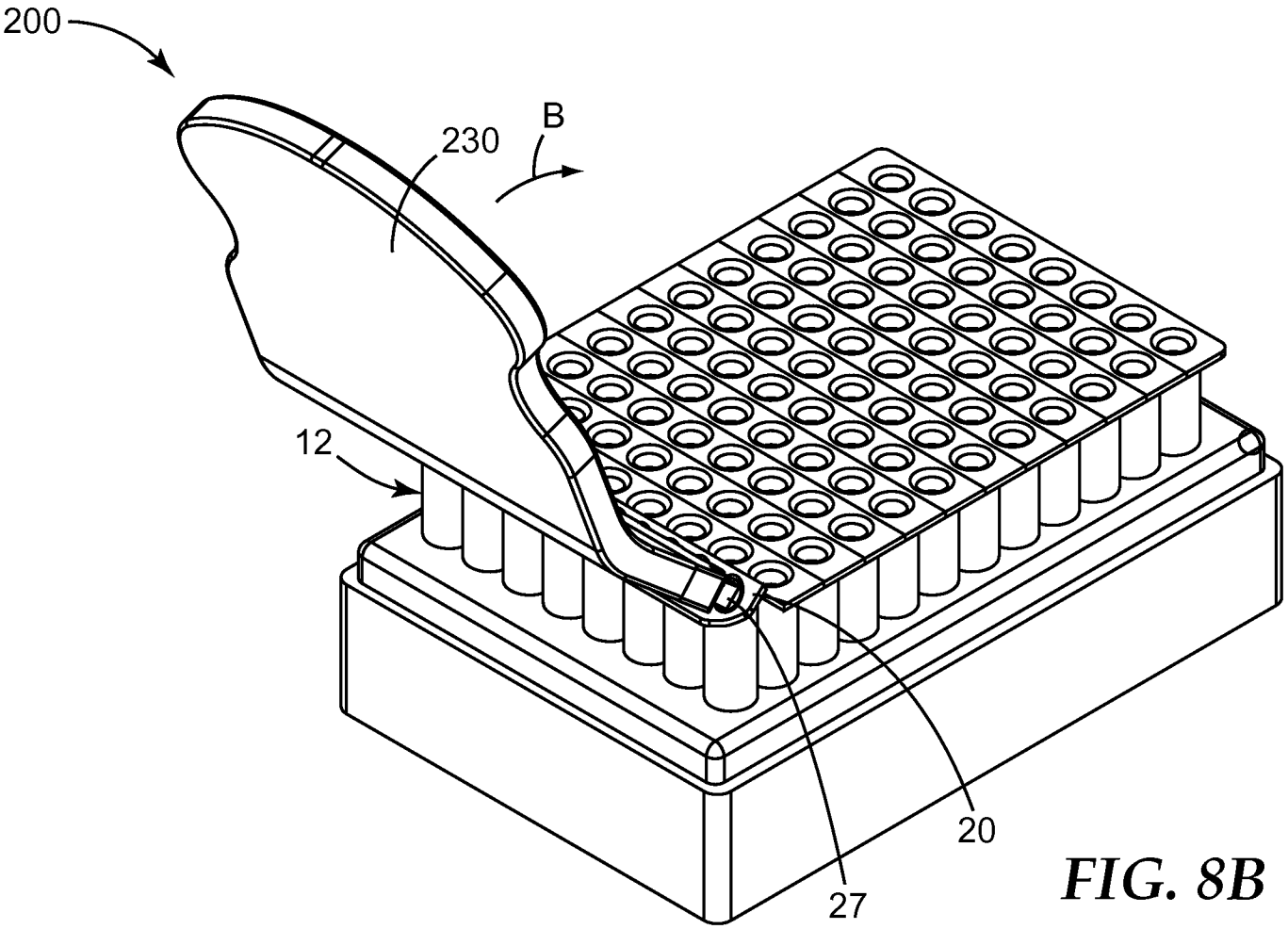
FIG. 8B shows a perspective view of the tool of FIG. 7A engaged in a second operable position with the capped tube assembly.

The first tool 100 of the present disclosure can be used to remove, in as few as two steps, the caps from plurality of tubes. One step in the decapping process includes engaging the caps with the tool, as shown and described for first tool 100 in FIGS. 4A-B. FIG. 8A shows first tool 100 engaged in a first operational position with the unitary closure device 20 of the capped tube assembly 10 shown and described in FIG. 1A. The first tool 100 and assembly 10 can be placed in the first operational position, for example, by having an operator (not shown) grasp the body 30 of the first tool 100, manually align one or more of the projections 60 of the first tool 100 with one or more openings (see opening 18 of FIG. 1B), and manually insert the one or more projections into the one or more openings. In the first operational position, at least one of the plurality of projections 60 is inserted through at least one of the openings (see opening 18 of FIG. 1A). Preferably, the at least one projection 60 is inserted through the openings until a portion of the base 52 of the first tool 100 contacts the top edge of at least one cap 22. More preferably, the at least one projection 60 is inserted through the openings until a portion of the base 52 contacts the two or more caps 22 adjacent the projection 60.

After the first tool 100 is placed into the first operational position shown in FIG. 3A, a plurality of caps 22 can be removed (e.g., simultaneously removed) from two or more tubes by rotating (e.g., manually rotating) the first tool 100 in the direction shown by arrow "A"). As the first tool is rotated one or more caps 22 are pried from the capped tube assembly 10 and, upon sufficient rotation of the first tool 100, the plurality of caps 22 separate from the assembly 10. Conveniently, the first tool 100 can be rotated either clockwise or counterclockwise. It is contemplated that, even though a capped tube assembly 10 may comprise more than two tubes (e.g., the assembly may comprise eight or twelve or more tubes), the first tool 100 may be used to decap two tubes or more than two tubes.

Upon further movement of the first tool 100 in direction "A" (not shown), the first tool 100 will be disposed in a position (e.g., the position shown in FIG. 5) where the unitary closure device 20 will be retained, for example by frictional and/or gravitational force, engaged with the projections 60 of the first tool 100. The first tool 100 can temporarily be placed on a surface 90 (e.g., a level surface such as a laboratory bench top, as depicted in FIG. 6) with the unitary closure device engaged with the projections 60 of the first tool 100. While the first tool is resting against the surface, the plurality of caps 22 is held on the first tool 100 in a position whereby no portion of a cap can contact the surface 90, thereby preventing contamination of the cap 22 with materials (e.g., chemicals, nucleic acids, microorganisms) that may be present on the surface 90. This permits the operator to use both hands to perform other tasks (e.g. the transfer of reagents or samples to or from one or more of the tubes. Subsequently, the unitary closure device 20 can be restored on the plurality of tubes 14 simply by reversing the motions that were used to remove the unitary closure device 20. The reverse rotation of the first tool 100 in the direction of arrow "B" urges the second projection element 64 toward the wall of the depressions 27. Because the second projection element 64 is relatively shorter than first projection element 62, the projection 60 slips out of the depression 27 without engaging the wall of the depression 27, thereby releasing the first tool 100 from the cap 22.

In any of the above embodiments, the first tool may further comprise an attachment means to temporarily hold the tool in a preselected position and/or at a preselected location. The attachment means may comprise, for example, a detachable coupling element such as one component of a hook-and-loop closure or a magnet. Advantageously, a magnet mounted on the second side (e.g., second side 47 shown in FIG. 2D) of the first tool could permit the operator to a ferrous metal instrument (e.g., an incubator) with the projections facing upward. This provides secure, temporary storage of the first tool (optionally, with one or more caps disposed thereon) while the operator performs a task (e.g., adding a reagent to one or more tubes). The operator can then retrieve the first tool and use it to recap the one or more tubes.

The present disclosure contemplates a tool for capping and decapping tubes, the tool (not shown) comprising a single projection, the projection comprising at least two spaced-apart projection elements. The tool may comprise a first portion configured for engagement by a user and a second portion comprising the projection. In some embodiments, the first portion may be substantially coplanar with the first portion. In some embodiments, the first portion may be substantially non-coplanar with the first portion. Any of the embodiments, the tool would provide the same advantages in capping or decapping a single cap from a tube as the advantages described for the tools configured for capping and decapping a plurality of tubes.

The present disclosure provides a second tool configured for use in removing at least one cap from a tube having a cap, the cap having a top surface with a depression with an inner wall. In a preferred embodiment, tools of the present disclosure are used to remove two or more spaced-apart, linearly-oriented caps (e.g., to remove two or more caps 22 of the unitary closure device 20 used to seal tubes in the capped tube assembly 10 of FIG. 1).

FIGS. 7A-E show one embodiment of a second tool 200 for decapping and capping tubes according to the present disclosure. The second tool 200 second tool 200 comprises a body 230 having a first portion 240 and a second portion 250. The body 230 preferably is rigid or semi-rigid and can be constructed from a variety of materials including, for example, metal, plastic, a ceramic material, a composite material, wood, or a combination of any two or more of the foregoing materials.

The first portion 240 of the second tool 200 second tool 200 is configured for engagement by a user. That is, the first portion 240 is intended to be grasped by a person or a machine. In any embodiment, the first portion may comprise an edge 242. Optionally, the edge 242 may comprise a curvate edge 242, for comfort and ease of grasping by a human operator. In any embodiment, the edge 242 further may comprise a bevel 244.

The second portion 250 of the second tool 200 second tool 200 comprises a plurality of spaced-apart projections 260. The projections 260 are linearly aligned along an operational axis of rotation "Y". The second tool 200 further may comprise an optional base 252. The base 252 is a reference point in the second tool that is located between the operational end (terminus 262) of a projection 260 and the first end 240 of the second tool 200. Additionally, the base 252 may function to control the depth of penetration of one or more adjacent projections 260 into the depression of a cap (not shown).

The spacing of the projections 260 is configured to coincide with the spacing of the depressions in a plurality of caps (for example, see FIGS. 1A-B) that may be removed using the second tool 200. The spacing may be determined by the spacing of the depressions in a unitary closure device as described herein and/or by the spacing of suitable receptacle structures in a rack configured to receive and hold the tubes described herein.

Each projection 260 comprises a terminus 262 and a longitudinal axis "Z" with a longitude "L" that extends from the base 252 to the terminus 262. The projections 260 are preferably constructed from a rigid material (e.g., metal, wood, plastic, ceramic, composite materials, or combinations thereof) and may be constructed from the same material as the body 230. In some embodiments, the body 230 and projections 260 may be formed as a unitary part, for example by injection-molding a thermoplastic polymer or by using a stamping process and/or machining process to form the projections in a unitary piece of metal or polymeric material.

Optionally, when making the second tool 200, the projections 260 can be formed on a separate part 254, which can be coupled to the first portion 250 of the body 230 via a fastener 280 such as a bolt, for example.

The largest cross-sectional area of the projection 260 that extends into the depression during use should fit within the cross-sectional area of the depression (see depression 27 of FIGS. 1A-B); unless the material from which the unitary closure device is constructed is sufficiently flexible to accommodate a projection 260 that has at least one dimension that is slightly larger than the opening. Preferably, the projections 260 are dimensioned to be slightly smaller than the opening, thereby facilitating the insertion and removal of the projections from the openings and also to facilitate contact between the projection 260 and the wall of a depression when using the second tool 200 to remove a cap (not shown) from one or more tubes (not shown).

Projections 260 may be formed in various shapes, and may be formed in shapes that are, for example, substantially cuboid, parallelepiped, ellipsoidal, or cylindrical. In the illustrated embodiment of FIG. 7A-E, each projection 260 is substantially parallelepiped.

At least one projection 260 can comprise a means for engaging the cap of a tube. The means for engaging the cap can include a cap-engaging face 264. In use, the cap-engaging face 264 contacts the wall of a depression in a cap (see FIG. 1A). Optionally, the cap-engaging face 264 further can comprise one or more angular edges (e.g., upper angular edge 265*a* and lower angular edge 265*b*). In some embodiments (e.g., the embodiment illustrated in FIGS. 7A-E), at least one of the one or more angular edges 265*a* and/or 265*b* is transversely oriented with respect to the longitudinal axis "Z". The transverse orientation advantageously provides an edge that can engage (e.g., "grip") a cap when the second tool 200 is moved from a first operational position to a second operational position as described below.

In any embodiment, the means for engaging the cap of a tube can comprise an abrasive surface. For example, the cap-engaging face 264 further can comprise a rough surface comprising either ordered or random structures that disrupt an otherwise smooth surface. These structures can facilitate the engagement of a cap and, thereby, prevent the projections from slipping out of the cap when the second tool is used.

Optionally, at least one projection 260 further can comprise a cap-releasing face 266 opposite the cap-engaging face 264. In contrast to the cap-engaging face 264, which can extend directly to the terminus 262 of the projection 260, the cap-releasing face 266 ends at a chamfer 267, which connects the cap-releasing face 266 to the terminus 262 of the projection 260. This can be seen in greater detail in FIG. 9A. The chamfer 267 may be substantially planar, as shown in the illustrated embodiment, or it may be rounded. The chamfer 267 substantially prevents the cap-releasing face 266 from operably engaging a cap when the second tool 200 is rotated on axis "Y" away from chamfer 267, as described below.

Figure 9A:
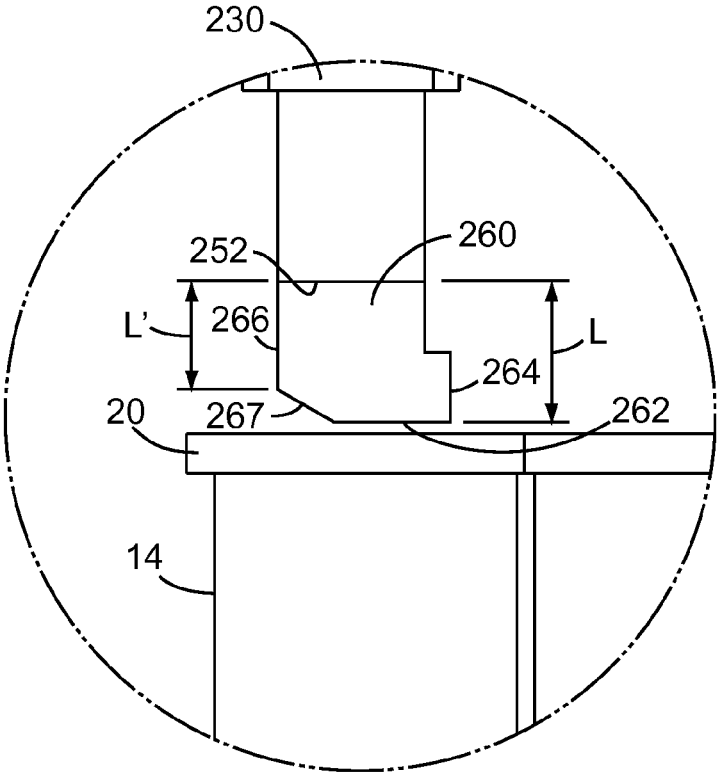
FIG. 9A shows a detailed side view of the second end of tool of FIG. 8A moving toward engagement in a first operable position with the capped tube assembly of FIG. 1A.

Second tools of the present disclosure can be used to remove, in as few as two steps, the caps from plurality of tubes. One step in the decapping process includes engaging the caps with the second tool. FIG. 9A shows the second tool 200 of FIGS. 7A-E aligned to be engaged in a first operational position with the unitary closure device 20 of a capped tube assembly 10. The plurality of tubes 14 in the capped tube assembly 10 are substantially aligned along the rotational axis "Y" (shown in FIGS. 7C and 7E). The second tool 200 and assembly 10 can be placed in the first operational position (shown in FIGS. 8A and 9B), for example, by having an operator (not shown) grasp the body 230 of the second tool 200, manually align one or more of the projections 260 of the second tool 200 with one or more openings (see opening 18 of FIG. 1A), and manually insert the one or more of the projections 260 into the one or more openings.

Figure 1B:
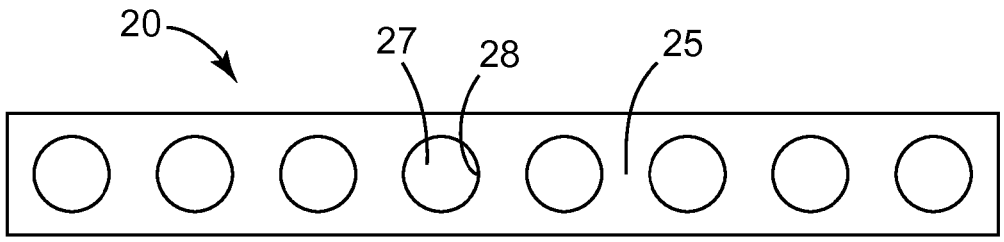
FIG. 1B is a top view of the capped tube assembly of FIG. 1.
Figure 9B:
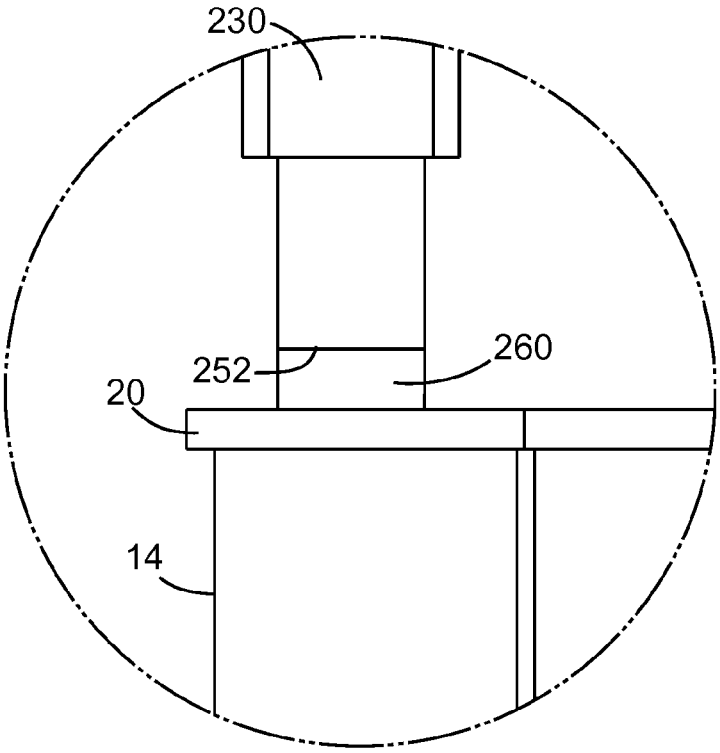
FIG. 9B shows a detailed side view of the tool of FIG. 8A engaged in a first operable position with the capped tube assembly of FIG. 1A.

FIGS. 9A-B show detail of the insertion of a projection 260 of the second tool 200 of FIG. 9A into the depression 27 of a cap 22 (see FIGS. 1A and 1B illustrating the depression 27 of a cap 22). The cap 22 is one of a plurality of caps in a unitary closure device 20 that is used to seal a plurality of tubes 14. The body 230 of second tool 200 is held while the projection 260 is aligned with the depression 27 and the tool is moved to insert the projection 260 into the depression 27 of the cap 22. Preferably, when placing the second tool 200 in the first operational position, the at least one projection 260 should be inserted into the depression 27 until the terminus 262 of the projection 260 contacts the bottom of the depression of the cap.

Figure 7A:
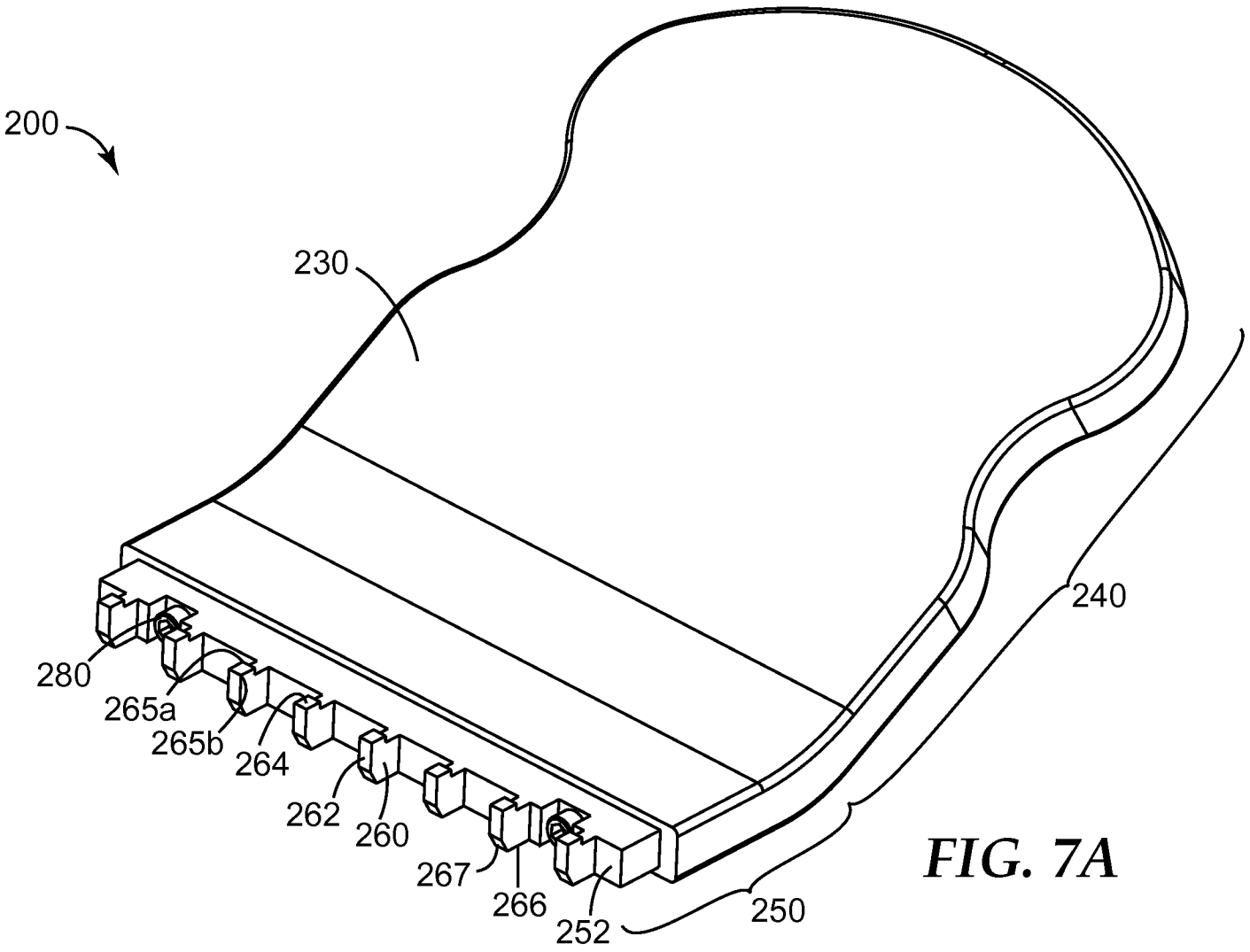
FIG. 7A is a perspective view of one embodiment of a tool for decapping and capping tubes according to the present disclosure.
Figure 7B:
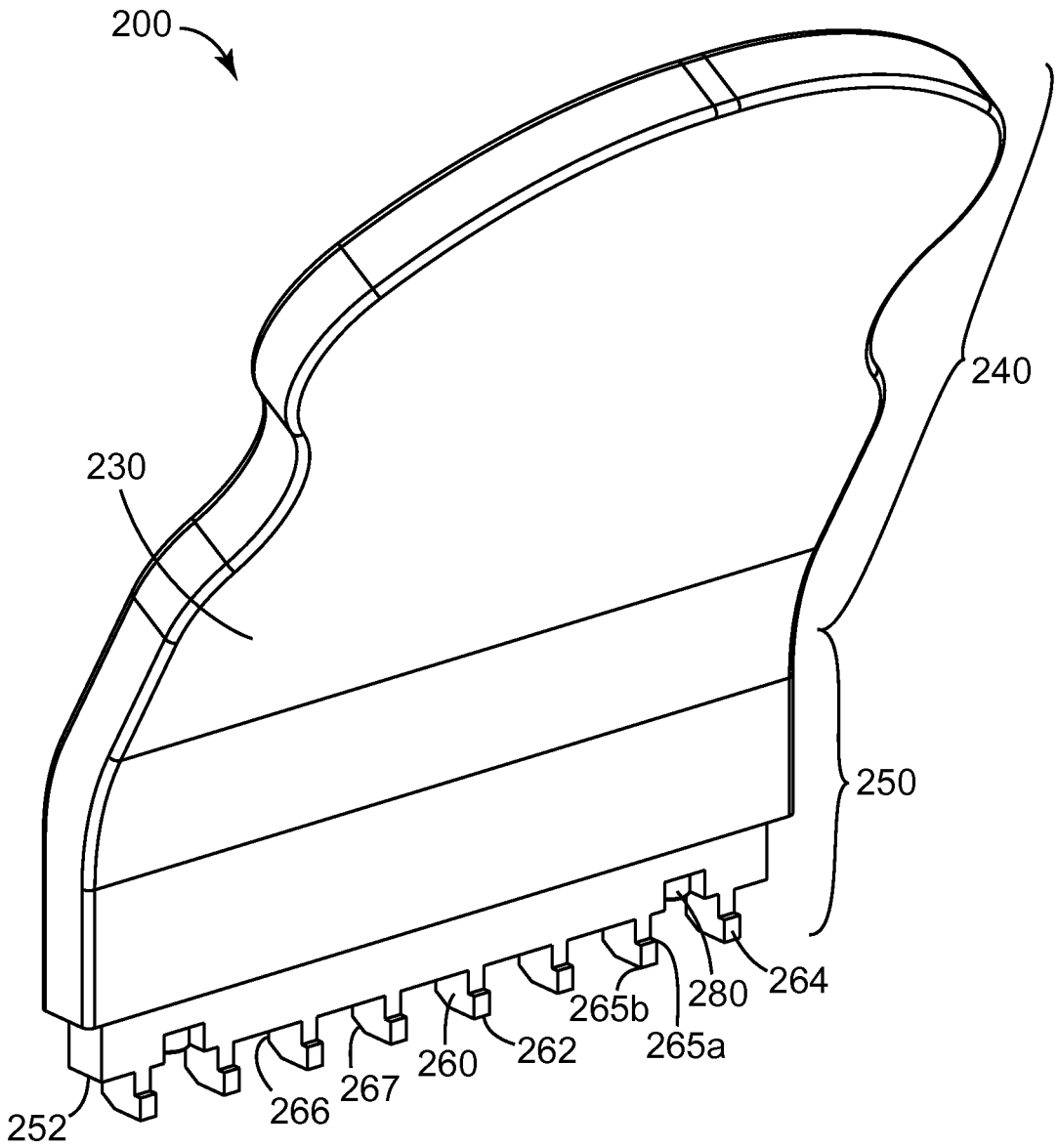
FIG. 7B is another perspective view of the tool of FIG. 7A.
Figure 7C:
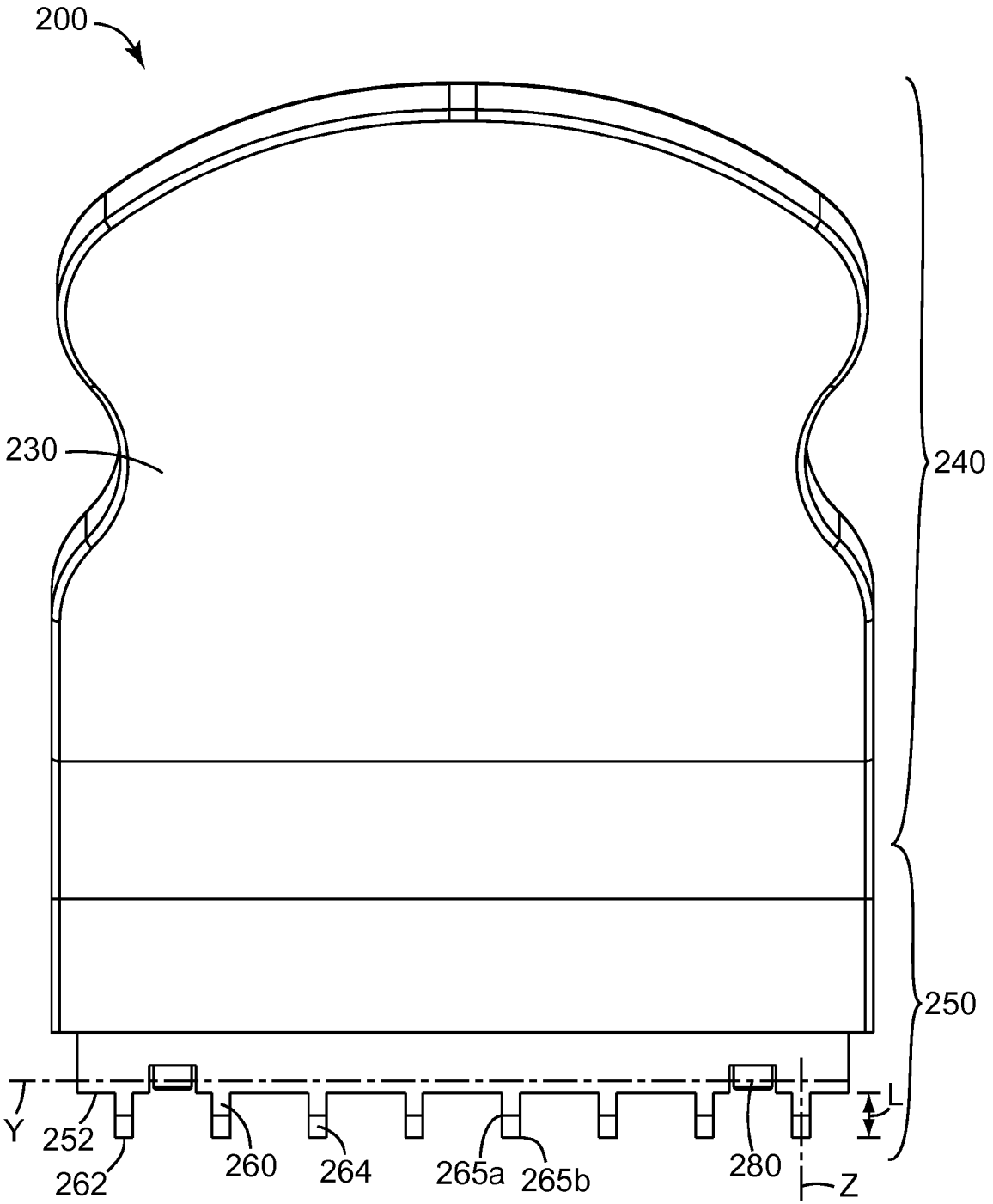
FIG. 7C is a plan view of the tool of FIG. 7A.
Figure 7D:
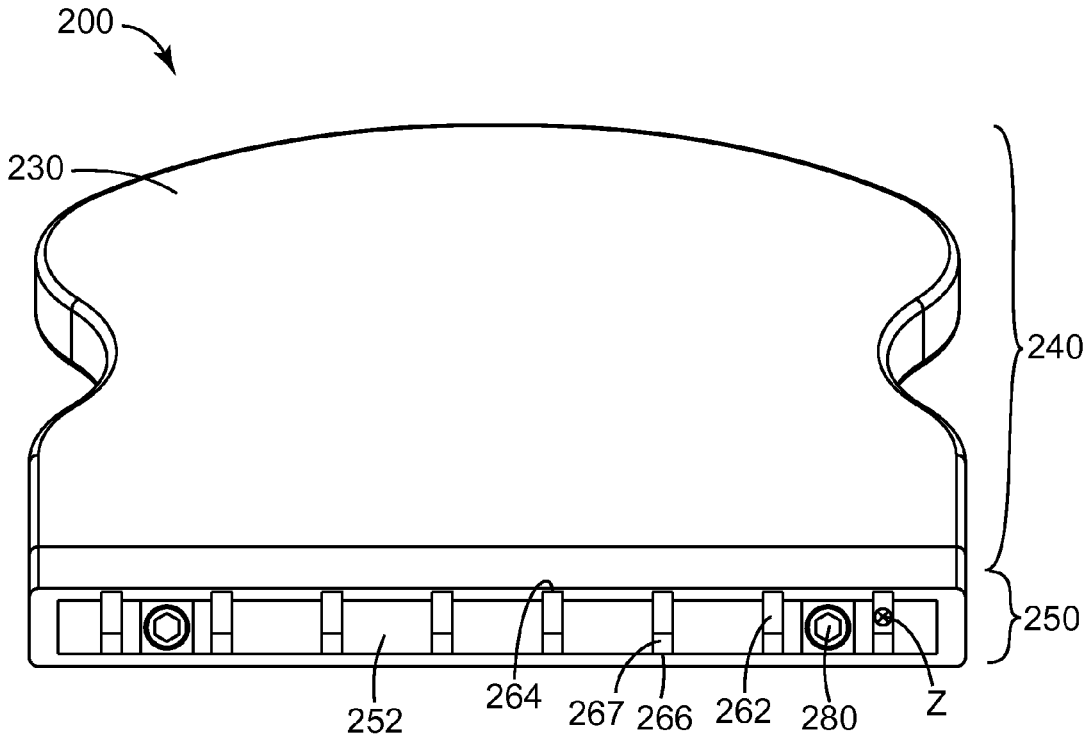
FIG. 7D is a bottom view of the tool of FIG. 7A.
Figure 7E:
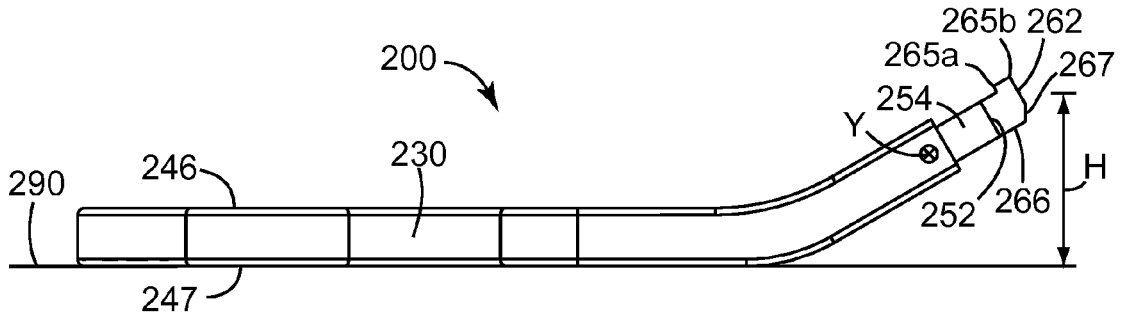
FIG. 7E is a side view of the tool of FIG. 7A disposed on a surface.

After the second tool 200 is placed into the first operational position shown in FIG. 8A, a plurality of caps 22 can be removed (e.g., simultaneously removed) from two or more tubes 14 by rotating (e.g., manually rotating) the second tool 200 about the tool axis "Y", as shown by arrow "A" in FIG. 8A, for example. As the second tool is rotated about the axis "Y", the bottom edge 24 of one or more caps 22 is pried from one or more tubes 14 and, upon sufficient rotation of the second tool 200, the plurality of caps 22 separate from the tubes 14. It is contemplated that, even though a capped tube assembly 10 may comprise more than two tubes 14 (e.g., the assembly may comprise eight or twelve or more tubes 14), the second tool 200 may be used to decap only one tube 14 or to decap two or more tubes. It should be noted that the rotation of the second tool 200 to decap the one or more tubes (i.e., rotation about axis "Y" in the direction of arrow "A" causes the rotation of the second tool 200 in the direction of the side of the second tool that includes the cap-releasing face 266 of the projection 260 (i.e., toward the second side (i.e., second side 247 of the first portion 240 of the second tool, see FIG. 7E) of the second tool 200, as shown in FIG. 7E). This rotational motion urges the cap-engaging face 264 of the projections 260 against the wall of the depressions of the caps of the tubes, thereby lifting the edge of the caps 22 out of the tubes 14.

Figure 10:
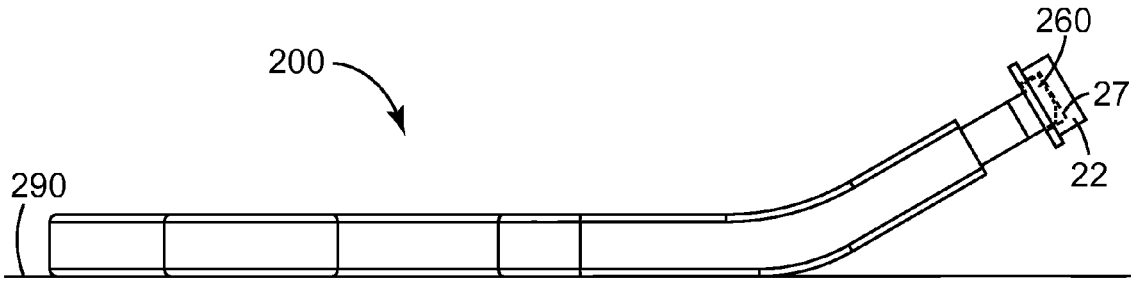
FIG. 10 shows a side view of the tool of FIG. 7A, with a unitary closure device engaged thereon, disposed on a surface.

After the unitary closure device 20 is separated from a plurality of tubes 14, if there is a sufficient friction fit between the projection 260 and the depression 27 of the cap 22 or if the second tool 200 is held at a sufficient angle (e.g., the plane of the body 30 is held at an angle where the projections are substantially perpendicular to the force of gravity or the projections are angled upward, away from the force of gravity), the unitary closure device 20 with a plurality of caps 22 can remain releasably engaged with the second tool 200, as shown in FIG. 10.

Figure 11A:
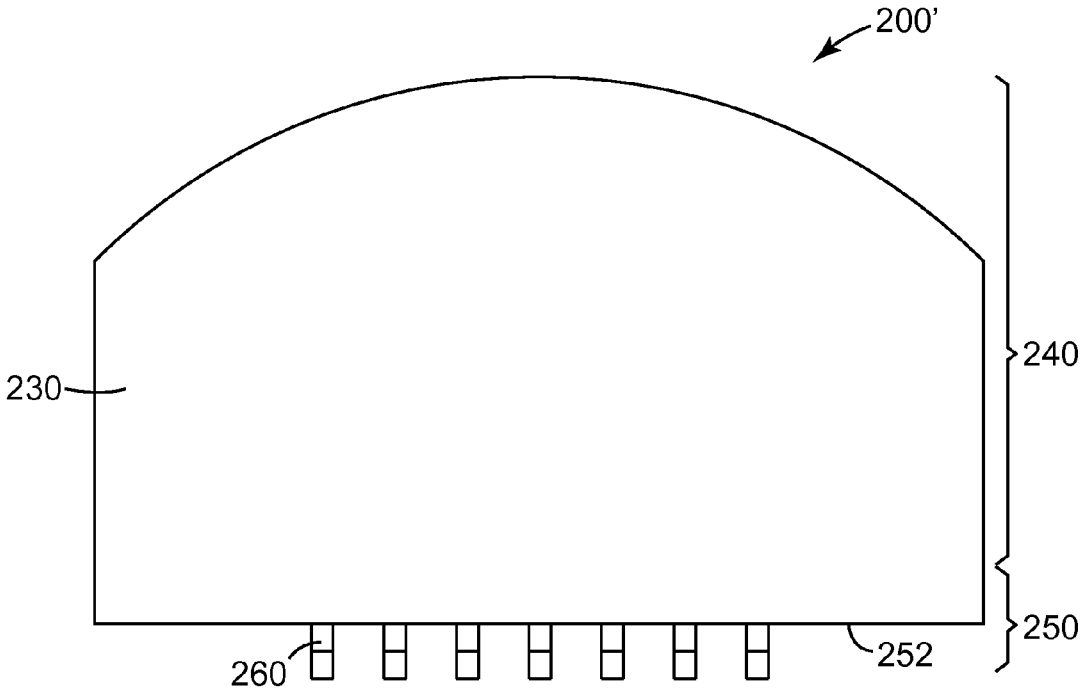
FIG. 11A shows a plan view of an alternative embodiment of a tool for decapping and capping tubes according to the present disclosure.
Figure 11B:
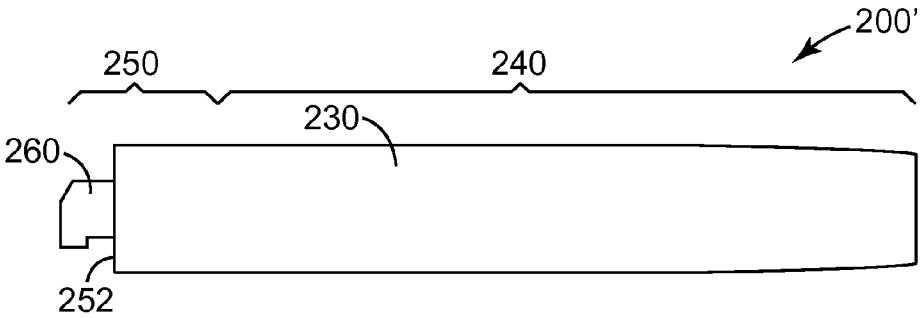
FIG. 11B is a side view of the tool of FIG. 11A.

FIG. 11A-B show one embodiment of a second tool 200' for handling a plurality of linearly-oriented, spaced-apart caps, each cap having an upper surface with a depression. The second tool 200' comprises a first portion 240 and second portion 250. The first portion 240 is configured for engagement by a user, as described above. The second portion 250 comprises a plurality of projections 260 configured to operationally engage, as described above, a plurality of linearly-aligned, spaced-apart caps, each cap having an upper surface with a depression. The projections extend from the base 252 of the body 230. The first portion 240 and second portion 250 are substantially coplanar.

Although the first and second ends of the second tool may be oriented in a substantially co-planar relationship (as shown in FIGS. 11A-B), optionally, in any of the above embodiments of the second tool for decapping and capping tubes (as illustrated in FIGS. 7A-7E), the first portion of the body can be configured in a non-coplanar relationship with respect to the second portion. FIG. 7E shows a side view of a second tool 200 for decapping and capping tubes, wherein the second tool 200 comprises a first portion 240 of the body 230 in non-coplanar relationship with a second portion 250. The first portion 240 of the second tool 200 is configured for engagement by a user, as described above. The second portion 250 comprises a plurality of projections 260 configured to operationally engage a plurality of linearly-aligned, spaced-apart caps, each cap having an upper surface with a depression. The first portion comprises a first side 246 and a second side 247. The second side 247 can be configured to be placed against a surface 290 such that, when the second side 247 of the first portion 240 is held against the surface 290, the distance "H" between the terminus 262 of the at least one projection 260 and the surface 290 is sufficient to hold any portion of a cap engaged (e.g., fully-engaged) on the projection 260 off the surface 290. Preferably, the distance "H" is sufficient to hold any portion of the projection-engaged cap (not shown) at least 2 mm off the surface. In some embodiments, the distance "H" is sufficient to hold any portion of the fully-engaged cap (not shown) at least 5 mm off the surface. In some embodiments, the distance "H" is sufficient to hold any portion of the fully-engaged cap (not shown) at least 10 mm off the surface. In some embodiments, the distance "H" is sufficient to hold any portion of the projection-engaged cap (not shown) more than 10 mm off the surface. In any embodiment, the first portion may comprise an edge 242. Optionally, the edge 242 may comprise a curvate edge 242, as described above. The second portion 250 of the second tool 200 comprises a base 252 with a plurality of spaced-apart projections 260 extending therefrom, both as described above.

In any of the embodiments, the first portion 240 of the second tool can have a greater mass than the second portion 250 of the second tool. Preferably, the mass of the first portion is greater than the mass of the second portion plus the mass of any caps disposed on one or more of the projections 260. Thus, when a tool (e.g., such as second tool 200 holding a cap as shown in FIG. 10, is placed on a surface 290 the mass of the first portion 240 can counterbalance the mass of the second portion 250 and the cap 22, thereby keeping the cap 22 from contacting the surface 290.

The second tool 200 of the present disclosure can be used to remove, in as few as two steps, the caps from plurality of tubes. One step in the decapping process includes engaging the caps with the second tool, as shown and described for second tool 200 in FIGS. 9A-B. FIG. 8A shows second tool 200 engaged in a first operational position with the unitary closure device 20 of the capped tube assembly 10 shown and described in FIG. 1A. The second tool 200 and assembly 10 can be placed in the first operational position, for example, by having an operator (not shown) grasp the body 230 of the second tool 200, manually align one or more of the projections 260 of the second tool 200 with one or more openings (see opening 18 of FIG. 1B), and manually insert the one or more projections into the one or more openings. In the first operational position, at least one of the plurality of projections 260 is inserted through at least one of the openings (see opening 18 of FIG. 1A). Preferably, the at least one projection 260 is inserted through the openings until a portion of the base 252 of the second tool 200 contacts the top edge of at least one cap 22. More preferably, the at least one projection 260 is inserted through the openings until a portion of the base 252 contacts the two or more caps 22 adjacent the projection 260.

After the second tool 200 is placed into the first operational position shown in FIG. 8A, a plurality of caps 22 can be removed (e.g., simultaneously removed) from two or more tubes by rotating (e.g., manually rotating) the second tool 200 in the direction shown by arrow "A"). As the second tool is rotated one or more caps 22 are pried from the capped tube assembly 10 and, upon sufficient rotation of the second tool 200, the plurality of caps 22 separate from the assembly 10. Conveniently, the second tool 200 can be rotated either clockwise or counterclockwise. It is contemplated that, even though a capped tube assembly 10 may comprise more than two tubes (e.g., the assembly may comprise eight or twelve or more tubes), the second tool 200 may be used to decap two tubes or more than two tubes.

Upon further movement (not shown) of the second tool 200 in direction "A", the second tool 200 will be disposed in a position (e.g., the position shown in FIG. 10) where the unitary closure device 20 will be retained, for example by frictional and/or gravitational force, engaged with the projections 260 of the second tool 200. The second tool 200 can temporarily be placed on a surface 290 (e.g., a level surface such as a laboratory bench top, as depicted in FIG. 10) with the unitary closure device engaged with the projections 260 of the second tool 200. While the second tool is resting against the surface, the plurality of caps 22 is held on the second tool 200 in a position whereby no portion of a cap can contact the surface 290, thereby preventing contamination of the cap 22 with materials (e.g., chemicals, nucleic acids, microorganisms) that may be present on the surface 290. This permits the operator to use both hands to perform other tasks (e.g. the transfer of reagents or samples to or from one or more of the tubes. Subsequently, the unitary closure device 20 can be restored on the plurality of tubes 14 simply by reversing the motions that were used to remove the unitary closure device 20. The reverse rotation of the second tool 200 in the direction of arrow "B" urges the cap-releasing face 266 of the projections 260 toward the wall of the depressions 27. Because the projection 260 has a chamfer 267 on the cap-releasing face 266 of the projection 260, the projection 260 slips out of the depression 27 without engaging the wall of the depression 27, thereby releasing the second tool 200 from the cap 22.

In any of the above embodiments, the second tool may further comprise an attachment means to temporarily hold the second tool in a preselected position and/or at a preselected location. The attachment means may comprise, for example, a detachable coupling element such as one component of a hook-and-loop closure or a magnet. Advantageously, a magnet mounted on the second side (e.g., second side 47 shown in FIG. 7E) of the second tool could permit the operator to a ferrous metal instrument (e.g., an incubator) with the projections facing upward. This provides secure, temporary storage of the second tool (optionally, with one or more caps disposed thereon) while the operator performs a task (e.g., adding a reagent to one or more tubes). The operator can then retrieve the second tool and use it to recap the one or more tubes.

Embodiments

Embodiment 1 is a tool for use in handling a plurality of linearly-oriented, spaced-apart caps, each cap having an upper surface with a depression; the tool comprising:

a body having a first portion for engagement by a user and a second portion to operationally engage one or more caps of the caps;

wherein the first portion is in a non-coplanar relationship with the second portion;

wherein the first portion has a first side and a second side;

wherein the second portion comprises a plurality of spaced-apart projections linearly aligned along a rotational axis, each projection having a terminus;

wherein the plurality of projections are aligned along a rotational axis;

wherein each projection of the plurality of projections is adapted to fit closely inside and to operationally engage the depression of one of the plurality of caps;

wherein the tool is configured such that, when the second side of the first portion is held against a substantially level surface, the distance between the terminus of each of the two or more projections and the surface is sufficient to hold any portion of a cap engaged on the one or more projections off the surface.

Embodiment 2 is the tool of embodiment 1, wherein the distance between the terminus of each of the two or more projections and the surface is sufficient to hold any portion of a cap that is engaged by either projection at least 2 mm off the surface.

Embodiment 3 is the tool of embodiment 2, wherein the distance between the terminus of each of the two or more projections and the surface is sufficient to hold any portion of a cap that is engaged by either projection at least 10 mm off the surface.

Embodiment 4 is the tool of any one of the preceding embodiments, wherein each of the two or more projections comprises a least two spaced-apart projection elements.

Embodiment 5 is the tool of any one of the preceding embodiments, wherein at least one projection element comprises a means for engaging the cap.

Embodiment 6 is the tool of embodiment 5, wherein the tool further comprises a base, wherein each projection of the plurality of projections comprises a longitudinal axis that defines a length of each projection element, wherein the length of a first projection element is longer than the length of a second projection element.

Embodiment 7 is the tool any one of embodiments 4 through 6, wherein at least one of the projection elements is adapted to be flexible.

Embodiment 8 is the tool of any one of embodiments 5 through 7, wherein the means for engaging comprises an edge.

Embodiment 9 is the tool of embodiment 8, wherein the edge comprises an angular edge.

Embodiment 10 is the tool of embodiment 8 or embodiment 9, wherein the edge is transversely oriented with respect to the first longitudinal axis.

Embodiment 11 is the tool of any one of embodiments 5 through 10, wherein the means for engaging comprises an abrasive surface.

Embodiment 12 is the tool of any one of the preceding embodiments, wherein the mass of the first portion is greater than the mass of the second portion.

Embodiment 13 is a tool for use in handling a plurality of linearly-oriented, spaced-apart caps, each cap having an upper surface with a depression having a wall; the tool comprising:

a body having a first portion for engagement by a user and a second portion to operationally engage one or more of the caps;

wherein the second portion comprises a plurality of spaced-apart projections linearly aligned along a rotational axis, each projection having a terminus;

wherein the two or more projections each are adapted to fit closely inside and to operationally engage the depression of one of the plurality of caps;

wherein each projection of the plurality of projections comprises at least two spaced-apart projection elements.

Embodiment 14 is the tool of embodiment 13, wherein at least one projection element comprises a means for engaging the cap.

Embodiment 15 is the tool of embodiment 13 or embodiment 14, wherein the tool further comprises a base, wherein each projection of the plurality of projections comprises a longitudinal axis that defines a length of each projection element, wherein the length of a first projection element is longer than the length of a second projection element.

Embodiment 16 is the tool any one of embodiments 13 through 15, wherein at least one of the projection elements is adapted to be flexible.

Embodiment 17 is the tool of any one of embodiments 14 through 16, wherein the means for engaging comprises an edge.

Embodiment 18 is the tool of embodiment 17, wherein the edge comprises an angular edge.

Embodiment 19 is the tool of embodiment 17 or embodiment 18, wherein the edge is transversely oriented with respect to the first longitudinal axis.

Embodiment 20 is the tool of any one of embodiments 14 through 19, wherein the means for engaging comprises an abrasive surface.

Embodiment 21 is the tool of any one of embodiments 13 through 20, wherein the mass of the first portion is greater than the mass of the second portion.

Embodiment 22 is the tool of any one of the preceding embodiments, further comprising a penetration control element.

Embodiment 23 is a method of handling a plurality of capped tubes; comprising:

providing a linear array of two or more spaced-apart capped tubes and the tool of any one of the preceding embodiments, wherein each cap has an upper surface with a depression;

inserting at least one projection into the depression in the cap of one or more of the tubes; and using the tool to remove the cap.

Embodiment 24 is the method of embodiment 23, wherein inserting at least one projection into the depression in the cap of one or more of the tubes further comprises inserting at least two projections into the depression in the cap of two or more of the tubes.

Embodiment 25 is the method of embodiment 23 or embodiment 24, further comprising:

while at least one cap is engaged on the tool, placing the first side of the tool against a substantially flat surface;

adding a substance to or removing a substance from at least one of the tubes; and using the tool to replace the at least one cap on the tubes.

Embodiment 26 is a tool for use in handling a cap having an upper surface with a depression; the tool comprising:

a body having a first portion for engagement by a user and a second portion to operationally engage the cap;

wherein the second portion comprises a projection comprising a terminus and at least two spaced-apart projection elements;

wherein the projection is adapted to fit closely inside and to operationally engage the depression of the cap;

wherein the tool has an operational axis of rotation.

Embodiment 27 is the tool of embodiment 26, wherein at least one projection element comprises a means for engaging the cap.

Embodiment 28 is the tool of embodiment 26 or embodiment 27, wherein the tool further comprises a base, wherein the projection comprises a longitudinal axis that defines a length of each projection element, wherein the length of a first projection element is longer than the length of a second projection element.

Embodiment 29 is the tool any one of embodiments 26 through 28, wherein at least one of the projection elements is adapted to be flexible.

Embodiment 30 is the tool of any one of embodiments 27 through 29, wherein the means for engaging comprises an edge.

Embodiment 31 is the tool of embodiment 30, wherein the edge comprises an angular edge.

Embodiment 32 is the tool of embodiment 30 or embodiment 31, wherein the edge is transversely oriented with respect to the first longitudinal axis.

Embodiment 33 is the tool of any one of embodiments 27 through 32, wherein the means for engaging comprises an abrasive surface.

Embodiment 34 is the tool of any one of embodiments 26 through 33, wherein the mass of the first portion is greater than the mass of the second portion.

Embodiment 35 is the tool of any one of embodiments 26 through 34, wherein the first portion is substantially non-coplanar with the second portion Embodiment 36 is the tool of embodiment 35;

wherein the first portion comprises a first side and a second side;

wherein the tool is configured such that, when the second side of the first portion is held against a substantially level surface, the distance between the terminus of the projection and the surface is sufficient to hold any portion of a cap engaged on the projection off the surface.

Embodiment 37 is the tool of embodiment 36, wherein the distance between the terminus of the projection and the surface is sufficient to hold any portion of a cap engaged by the projection at least 2 mm off the surface.

Embodiment 38 is the tool of embodiment 37, wherein the distance between the terminus of the projection and the surface is sufficient to hold any portion of a cap engaged by the projection at least 10 mm off the surface.

Embodiment 39 is the tool of any one of embodiments 26 through 38, further comprising a penetration control element.

Embodiment 40 is a method of handling a capped tube, comprising:

providing a capped tube and the tool of any one of embodiments 26 through 39, wherein the cap comprises an upper surface with a depression;

inserting the projection into the depression of the cap; and using the tool to remove the cap from the tube.

Embodiment 41 is the method of embodiment 40, further comprising:

while the cap is engaged on the tool, placing the first side of the tool against a substantially flat surface;

adding a substance to or removing a substance from the tube.

Embodiment 42 is the method of embodiment 40 or 41, further comprising using the tool to replace the cap on the tube.

Embodiment 43 is a tool for use in handling a plurality of linearly-oriented, spaced-apart caps, each cap having an upper surface with a depression; the tool comprising:

a body having a first portion configured for engagement by a user and a second portion configured to operationally engage one or more of the caps;

wherein the second portion comprises a plurality of spaced-apart projections linearly aligned along a rotational axis, each projection having a terminus;

wherein each projection of the plurality of projections is adapted to fit closely inside and to operationally engage the depression of one of the plurality of caps.

Embodiment 44 is the tool of embodiment 43, wherein at least one projection of the plurality of projections comprises a means for engaging the depression.

Embodiment 45 is the tool of embodiment 44, wherein the means for engaging the depression comprises a cap-engaging face.

Embodiment 46 is the tool of embodiment 45, wherein the cap-engaging face comprises at least one angular edge.

Embodiment 47 is the tool of embodiment 46, wherein the cap-engaging face comprises at least two angular edges.

Embodiment 48 is the tool of embodiment 46 or embodiment 47, wherein the at least one projection of the plurality of projections further comprises a longitudinal axis, wherein the at least one angular edge is transversely oriented with respect to the longitudinal axis.

Embodiment 49 is the tool of any one of embodiments 44 through 48, wherein the means for engaging a depression comprises an abrasive surface.

Embodiment 50 is the tool of any one embodiments 43 through 49, wherein the at least one of the plurality of projections further comprises a cap-releasing face.

Embodiment 51 is the tool of embodiment 50, wherein the cap-releasing face is connected to the terminus via a chamfer.

Embodiment 52 is the tool of any one of embodiments 43 through 51, wherein the mass of the first portion is greater than the mass of the second portion.

Embodiment 53 is the tool of any one of embodiments 43 through 52, wherein the tool further comprises a first side and a second side, wherein the tool is configured such that, when the first side of the first portion is held against a substantially level surface, the distance between the terminus of each of the two or more projections and the surface is sufficient to hold any portion of the one or more caps engaged by each of the one or more projections off the surface.

Embodiment 54 is the tool of embodiment 53, wherein the distance between the terminus of each of the two or more projections and the surface is sufficient to hold any portion of a cap that is engaged by either projection at least 2 mm off the surface.

Embodiment 55 is the tool of embodiment 53, wherein the distance between the terminus of at least one projection of the plurality of projections and the surface is sufficient to hold any portion of a cap that is engaged by either projection at least 10 mm off the surface.

Embodiment 56 is the tool of any one of embodiments 43 through 55, wherein the mass of the first portion is greater than the mass of the second portion.

Embodiment 57 is a method of handling a plurality of tubes; comprising:

providing a linear array of a plurality of tubes, the tubes containing a sample and each tube being closed with a cap, each cap having an upper surface with a depression, and the tool of any one of embodiments 43 through 56;

inserting a projection into the depression of a cap in a tube; and using the tool to remove the cap from the tube.

Embodiment 58 is the method of embodiment 57, wherein using the tool to remove the caps comprises rotating the tool in a first direction about the rotational axis.

Embodiment 59 is the method of embodiment 57 or embodiment 58, further comprising:

while the cap is engaged on the tool, placing the second side of the tool against a substantially flat surface;

adding a substance to or removing a substance from the tube; and using the tool to replace the cap on the tube.

Embodiment 60 is the method of embodiment 59, wherein using the tool to recap the tubes comprises rotating the tool about the rotational axis in a direction opposite the first direction.

A number of embodiments of a tool adapted for decapping and capping tubes have been described. For example, in some embodiments, the tool comprises first and second portions that are in non-coplanar relationship to one another. In some embodiments, the tool further can comprise attachment means, to facilitate the temporary storage of the tool against a surface (e.g., a substantially vertical surface) while the operator performs a task.

Nevertheless, various modifications may be made without departing from the spirit and scope of the invention. For example, one or more features described herein may be used with or without other described features. Moreover, several features described herein may be used in a tool to open containers other than tubes. These and other embodiments are within the scope of the following claims.

The invention claimed is:

1. A tool for use in handling a plurality of linearly-oriented, spaced-apart caps, each cap having an upper surface with a depression; the tool comprising:

a body having a first portion for engagement by a user and a second portion to operationally engage one or more caps of the caps;

wherein the first portion is in a non-coplanar relationship with the second portion;

wherein the first portion has a first side and a second side;

wherein the second portion comprises a plurality of spaced-apart projections linearly aligned along a rotational axis, each projection having a terminus;

wherein the plurality of projections are aligned along a rotational axis;

wherein each projection of the plurality of projections is adapted to fit closely inside and to operationally engage the depression of one of the plurality of caps;

wherein the tool is configured such that, when the second side of the first portion is held against a substantially level surface, the distance between the terminus of each of the two or more projections and the surface is sufficient to hold any portion of a cap engaged on the one or more projections off the surface;

wherein the first portion has a first mass and the second portion has a second mass;

wherein the first mass is greater than the second mass.

2. The tool of claim 1, wherein the distance between the terminus of each of the two or more projections and the surface is sufficient to hold any portion of a cap that is engaged by either projection at least 2 mm off the surface.

3. The tool of claim 1, wherein each of the two or more projections comprises a least two spaced-apart projection elements.

4. The tool of claim 3, wherein at least one projection element comprises a means for engaging the cap.

5. The tool of claim 4; wherein the means for engaging comprises an edge.

6. The tool of claim 5, wherein the edge comprises an angular edge.

7. The tool of claim 5, wherein each projection comprises a first longitudinal axis, wherein the edge is transversely oriented with respect to the first longitudinal axis.

8. The tool of claim 1, further comprising a penetration control element.

9. The tool of any one of claim 4; wherein the means for engaging comprises an abrasive surface.

10. A method of handling a plurality of capped tubes; comprising:

providing a linear array of two or more spaced-apart capped tubes and the tool of claim 1, wherein each cap has an upper surface with a depression;

inserting at least one projection into the depression in the cap of one or more of the tubes; and using the tool to remove the cap.

11. The method of claim 10, further comprising:

while at least one cap is engaged on the tool, placing the first side of the tool against a substantially flat surface;

adding a substance to or removing a substance from at least one of the tubes; and using the tool to replace the at least one cap on the tubes.

* * * * *